US009082344B2

(12) United States Patent
Shin

(10) Patent No.: US 9,082,344 B2
(45) Date of Patent: Jul. 14, 2015

(54) PIXEL CIRCUIT IN FLAT PANEL DISPLAY DEVICE AND METHOD FOR DRIVING THE SAME

(75) Inventor: Dong-Yong Shin, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 1046 days.

(21) Appl. No.: 10/985,797

(22) Filed: Nov. 10, 2004

(65) Prior Publication Data

US 2005/0110723 A1 May 26, 2005

(30) Foreign Application Priority Data

Nov. 25, 2003 (KR) ..... 2003-84235

(51) Int. Cl.

*G09G 3/30* (2006.01)
*G09G 3/32* (2006.01)
*G09G 3/22* (2006.01)

(52) U.S. Cl.

CPC ..... *G09G 3/3233* (2013.01); *G09G 3/22* (2013.01); *G09G 2300/0452* (2013.01); *G09G 2300/0465* (2013.01); *G09G 2300/0804* (2013.01); *G09G 2300/0814* (2013.01); *G09G 2300/0842* (2013.01); *G09G 2310/0235* (2013.01); *G09G 2320/0606* (2013.01); *G09G 2320/0666* (2013.01)

(58) Field of Classification Search

USPC ..... 345/76–82, 204–699; 35/76; 315/169.1
See application file for complete search history.

(56) References Cited

U.S. PATENT DOCUMENTS 5,019,807 A 5/1991 Stapleton et al.
5,032,829 A * 7/1991 Shoji et al. ..... 345/79
5,210,472 A * 5/1993 Casper et al. ..... 315/349
5,812,105 A * 9/1998 Van de Ven ..... 345/83
5,982,345 A * 11/1999 Takayama et al. ..... 345/76

(Continued)

FOREIGN PATENT DOCUMENTS

EP 0 762 374 B1 3/1997
EP 1 457 953 A1 9/2004

(Continued)

OTHER PUBLICATIONS

China Office action dated Aug. 24, 2007, for CN200410096235.1, with English translation.

(Continued)

*Primary Examiner* — Grant Sitta
(74) *Attorney, Agent, or Firm* — Christie, Parker & Hale, LLP

(57) ABSTRACT

A display device for displaying a predetermined color during an interval. The display device includes a plurality of pixels, each said pixel having at least two light emitting elements. Each light emitting element emits a corresponding color within the interval. Some of the light emitting elements of two adjacent said pixels are grouped into a first light emitting element group and the remaining light emitting elements of the two adjacent said pixels are grouped into a second light emitting element group. The first light emitting element group and the second light emitting element group are time-divisionally driven, one of the first and second light emitting element groups being driven within a given period, thereby displaying the predetermined color within the interval. The interval is one frame, and the one frame is divided into two subframes. The first and second light emitting element groups are time-sharingly driven.

37 Claims, 18 Drawing Sheets

(56) References Cited

U.S. PATENT DOCUMENTS

| | | | | |
|---|---|---|---|---|
| 6,097,365 | A * | 8/2000 | Makino | 345/99 |
| 6,414,662 | B1 * | 7/2002 | Havel | 345/83 |
| 6,421,033 | B1 * | 7/2002 | Williams et al. | 345/55 |
| 6,618,031 | B1 * | 9/2003 | Bohn et al. | 345/83 |
| 6,900,785 | B2 * | 5/2005 | Kimura | 345/76 |
| 7,129,914 | B2 * | 10/2006 | Knapp et al. | 345/76 |
| 7,148,864 | B2 * | 12/2006 | Okuda | 345/76 |
| 7,218,298 | B2 * | 5/2007 | Yamazaki et al. | 345/83 |
| 7,245,276 | B2 * | 7/2007 | Yamada | 345/76 |
| 2002/0003517 | A1 * | 1/2002 | Ashizawa et al. | 345/76 |
| 2002/0126074 | A1 * | 9/2002 | Ouellette et al. | 345/87 |
| 2003/0107560 | A1 | 6/2003 | Yumoto et al. | |
| 2003/0227262 | A1 * | 12/2003 | Kwon | 315/169.3 |
| 2004/0212633 | A1 | 10/2004 | Natori et al. | |

FOREIGN PATENT DOCUMENTS

| | | | |
|---|---|---|---|
| GB | EP1457953 | * | 11/2002 |
| JP | 3-39717 | | 2/1991 |
| JP | 8-248929 | | 9/1996 |
| JP | 9-138659 | | 5/1997 |
| JP | 9-311667 | | 12/1997 |
| JP | 2001-60076 | | 3/2001 |
| JP | 2002-40990 | | 2/2002 |
| JP | 2002-149112 | | 5/2002 |
| JP | 2002-215093 | | 7/2002 |
| JP | 2002-297083 | | 10/2002 |
| JP | 2003-510661 | | 3/2003 |
| JP | 2003-99000 | | 4/2003 |
| JP | 2003-108032 | | 4/2003 |
| JP | 2003-122306 | | 4/2003 |
| JP | 2003122306 A | * | 4/2003 |
| JP | 2003-195811 | | 7/2003 |
| JP | 2003-255899 | | 9/2003 |
| JP | 2005-148749 | | 6/2005 |
| JP | 2005-148750 | | 6/2005 |
| JP | 2005-148751 | | 6/2005 |
| JP | 2005-520193 | | 7/2005 |
| KR | 2002-0066190 | | 8/2002 |
| WO | WO 01/06484 A1 | | 1/2001 |
| WO | WO 03/038793 A1 | | 5/2003 |
| WO | WO 03/054838 A1 | | 7/2003 |
| WO | WO 03/077231 A2 | | 9/2003 |
| WO | WO 03/091977 A1 | | 11/2003 |

OTHER PUBLICATIONS

Office Action issued May 29, 2007 for corresponding Japanese Patent Application No. 2004-131246 and English translation.

Notice of Allowability dated May 25, 2007 for corresponding Korean Patent Application No. 10-2003-0084235 and English translation.

Patent Abstracts of Japan, Publication No. 2003-099000; Date of Publication: Apr. 4, 2003; in the name of Atsuhiro Yamano.

Patent Abstracts of Japan, Publication No. 2003-108032; Date of Publication: Apr. 11, 2003; in the name of Katsuya Anzai.

Patent Abstracts of Japan, Publication No. 2003-122306; Date of Publication: Apr. 25, 2003; in the name of Akira Yumoto.

Patent Abstracts of Japan, Publication No. 2003-195811; Date of Publication: Jul. 9, 2003; in the name of Katsumi Abe.

Patent Abstracts of Japan, Publication No. 2003-255899; Date of Publication: Sep. 10, 2003; in the name of Hiroshi Tsuchiya et al.

Korean Patent Abstracts, Publication No. 1020020066190 A; Date of Publication: Aug. 14, 2002; in the name of Naoaki Komiya.

Office Action issued May 29, 2007 for corresponding Japanese Patent Application No. 2004-131246.

Notice of Allowability dated May 25, 2007 for corresponding Korean Patent Application No. 10-2003-0084235.

Patent Abstracts of Japan, Publication No. 03-039717; Date of Publication: Feb. 20, 1991; in the name of Kiyoshige Kinugawa et al.

Patent Abstracts of Japan, Publication No. 08-248929; Date of Publication: Sep. 27, 1996; in the name of Atsuyoshi Tanioka et al.

Patent Abstracts of Japan, Publication No. 09-311667; Date of Publication: Dec. 2, 1997; in the name of Takehisa Kato.

Patent Abstracts of Japan, Publication No. 2002-040990; Date of Publication: Feb. 8, 2002; in the name of Yoshifumi Tanada.

Patent Abstracts of Japan, Publication No. 2002-215093; Date of Publication: Jul. 31, 2002; in the name of Akira Yumoto et al.

Patent Abstracts of Japan, Publication No. 2002-297083; Date of Publication: Oct. 9, 2002; in the name of Hideto Kitakado et al.

European Search Report dated Mar. 3, 2005, for EP 04090456.7, in the name of Samsung SDI Co., Ltd.

European Search Report dated Jan. 22, 2008, for European application 07110828.6, indicating relevance of references in this IDS (except Japan).

Patent Abstracts of Japan, Publication No. 09-138659, dated May 27, 1997, in the name of Chan-Long Shieh et al.

Patent Abstracts of Japan, Publication No. 2001-060076, dated Mar. 6, 2001, in the name of Mitsunobu Seikiya et al.

Patent Abstracts of Japan, Publication No. 2002-149112, dated May 24, 2002, in the name of Jun Koyama.

Patent Abstracts of Japan, Publication No. 2005-148749, dated Jun. 9, 2005, in the name of Won-Kyu Kwak et al.

Patent Abstracts of Japan, Publication No. 2005-148750, dated Jun. 9, 2005, in the name of Won-Kyu Kwak.

Patent Abstracts of Japan, Publication No. 2005-148751, dated Jun. 9, 2005, in the name of Won-Kyu Kwak et al.

* cited by examiner

PIXEL CIRCUIT IN FLAT PANEL DISPLAY DEVICE AND METHOD FOR DRIVING THE SAME

CROSS-REFERENCE TO RELATED APPLICATION

This application claims priority to and the benefit of Korean Patent Application No. 2003-84235, filed on Nov. 25, 2003 with the Korean Intellectual Property Office, the entire disclosure of which is incorporated herein by reference.

BACKGROUND OF THE INVENTION

1. Field of the Invention

The present invention relates to an emissive display device and, more particularly, to an organic light emitting device (OLED) display and a method of time-divisionally driving two light emitting elements among R, G and B electroluminescent (EL) elements of two adjacent pixels.

2. Description of the Related Art

Recently, liquid crystal displays (LCDs) and OLED displays are widely used as portable information displays having features such as light weight, thin profile, and the like. The OLED displays have better performance in terms of luminance and wide viewing angle than LCDs, such that they attract an attention as next generation flat panel displays.

Generally, in an active matrix OLED display, one pixel is composed of R, G and B unit pixels each including an EL element. In each EL element, an R, G or B organic emission layer is interposed between an anode electrode and a cathode electrode, so that light is emitted from the R, G and B organic emission layers by voltages applied to the anode electrode and the cathode electrode.

FIG. 1 illustrates a configuration of a conventional active matrix OLED 10.

Referring to FIG. 1, the conventional active matrix OLED 10 includes a pixel portion 100, a gate line driving circuit 110, a data line driving circuit 120 and a control unit (not shown). The pixel portion 100 includes a plurality of gate lines 111-11*m* to which scan signals S1-Sm are provided from the gate line driving circuit 110, a plurality of data lines 121 (121R, 121G, 121B)-12*n* (12*n*R, 12*n*G, 12*n*B) for supplying data signals (DR1, DG1, DB1)-(DRn, DGn, DBn) from the data line driving circuit 120, and a plurality of power lines 131 (131R, 131G, 131B) to 13*n* (13*n*R, 13*n*G, 13*n*B) for providing power supply voltages VDD1-VDDn.

In the pixel portion 100, a plurality of pixels P11-Pmn connected to the plurality of gate lines 111-11*m*, the plurality of data lines 121-12*n*, and the plurality of power lines 131-13*n* are arranged in a matrix form. Each of the pixels P11-Pmn is composed of three unit pixels, i.e., R, G and B unit pixels (PR11, PG11, PB11)-(PRmn, PGmn, PBmn), and is connected to the corresponding one gate line, one data line and one power supply line of the plurality of gate lines, data lines, and power supply lines.

For example, the pixel P11 is composed of an R unit pixel PR11, a G unit pixel PG11 and a B unit pixel PB11. The pixel P11 is connected to a first gate line 111 of the plurality of gate lines 111-11*m* that provides a first scan signal S1, a first data line of the plurality of data lines 121-12*n*, and a first power line 131 of the plurality of power lines 131-13*n*.

In other words, the R unit pixel PR11 of the pixel P11 is connected to the first gate line 111, an R data line 121R, to which an R data signal DR1 is provided, of the first data lines 121, and an R power line 131R of the first power lines 131. The G unit pixel PG11 is connected to the first gate line 111, a G data line 121G, to which a G data signal DG1 is provided, of the first data lines 121, and a G power line 131G of the first power lines 131. The B unit pixel PB11 is connected to the first gate line 111, a B data line 121B, to which a B data signal DB1 is provided, of the first data lines 121, and a B power line 131B of the first power lines 131.

FIG. 2 shows a pixel circuit of the conventional OLED, illustrating a circuit diagram of one pixel P11 composed of R, G and B unit pixels.

Referring to FIG. 2, the R unit pixel PR11 of the R, G and B unit pixels PR11, PG11, PB11 constituting the pixel P11 includes a switching transistor M1_R in which the scan signal S1 applied from the first gate line 111 is provided to a gate, and the data signal DR1 from the R data line 121R is provided to a source. The R unit pixel PR11 also includes a driving transistor M2_R in which a gate is connected to a drain of the switching transistor M1_R and the power supply voltage VDD1 from the power supply line 131R is provided to a source. A capacitor C1_R is connected between the gate and the source of the driving transistor M2_R. In addition, the R unit pixel PR11 includes an R EL element EL1_R in which an anode is connected to a drain of the driving transistor M2_R and a cathode is connected to a ground voltage VSS.

Likewise, the G unit pixel PG11 includes: a switching transistor M1_G in which the scan signal S1 applied from the first gate line 111 is provided to a gate, and the data signal DG1 from the G data line 121G is provided to a source. The G unit pixel PG11 also includes a driving transistor M2_G in which a gate is connected to a drain of the switching transistor M1_G and the power supply voltage VDD1 from the power supply line 131G is provided to a source. A capacitor C1_G is connected between the gate and the source of the driving transistor M2_G. In addition, the G unit pixel PG11 includes a G EL element EL1_G in which an anode is connected to a drain of the driving transistor M2_G and a cathode is connected to the ground Vss.

Further, the B unit pixel PB11 includes a switching transistor M1_B in which the scan signal S1 applied from the first gate line 111 is provided to a gate and the data signal DB1 from the B data line 121B is provided to a source. The B unit pixel PB11 also includes a driving transistor M2_B in which a gate is connected to a drain of the switching transistor M1_B and the power supply voltage VDD1 from the power supply line 131B is provided to a source. A capacitor C1_B is connected between the gate and the source of the driving transistor M2_B. In addition, the B unit pixel PB11 includes a B EL element EL1_B in which an anode is connected to the drain of the driving transistor M2_B and a cathode is connected to the ground voltage VSS.

In an operation of the pixel circuit illustrated above, when the scan signal S1 is applied to the gate line 111, the switching transistors M1_R, M1_G, M1_B of the R, G and B unit pixels constituting the pixel P11 are driven thereby, and the R, G and B data DR1, DG1, DB1 from the R, G and B data lines 121R, 121G, 121B are applied, respectively, to the gates of the driving transistors M2_R, M2_G, and M2_B.

The driving transistors M2_R, M2_G, M2_G provide the EL elements EL1_R, EL1_G, EL1_B with respective driving currents corresponding to a difference between the data signals DR1, DG1, DB1 applied to the gates and the power supply voltage VDD1 supplied from respective R, G and B power supply lines 131R, 131G, 131B. The EL elements EL1_R, EL1_G, EL1_B are driven by the driving currents applied through the respective driving transistors M2_R, M2_G, M2_B, thereby resulting in driving the pixel P11. The capacitors C1_R, C1_G, C1_B store the respective data signals DR1, DG1, DB1 applied to the R, G and B data lines 121R, 121G and 121B.

The operation of the conventional OLED having a configuration as illustrated above will now be described with reference to the driving waveform diagram of FIG. 3.

First, when the scan signal S1 is applied to the first gate line 111, the first gate line is driven, and then, the pixels P11-P1*n* connected to the first gate line 111 are driven.

In other words, the switching transistors of the R, G and B unit pixels (PR11-PR1*n*), (PG11-PG1*n*), (PB11-PB1*n*) of the pixels P11-P1*n* connected to the first gate line 111 are driven by the scan signal S1 applied to the first gate line 111. When the switching transistors are driven, the R, G and B data signals D(S1) (DR1-DRn), (DG1-DGn), (DB1-DBn) from the R, G and B data lines (121R-12*n*R), (121G-12*n*G), (121B-12*n*B) constituting the first to the $n_{th}$ data lines 121 to 12*n* are respectively applied to the gates of the driving transistors of the R, G and B unit pixels at the same time.

The driving transistors of the R, G and B unit pixels provide the R, G and B EL elements with the driving currents corresponding to the R, G and B data signals D (S1) (DR1 to DRn), (DG1 to DGn), (DB1 to DBn) each applied to the R, G and B data lines 121R to 121*n*R, 121G to 12*n*G, 121B to 12*n*B. Therefore, when the scan signal S1 is applied to the first gate line 111, the EL elements constituting the R, G and B unit pixels (PR11-PR1*n*), (PG11-PG1*n*), (PB11-PB1*n*) of the pixels P11-P1*n* connected to the first gate line 111 are driven at the same time.

Likewise, when the scan signal S2 for driving a second gate line 112 is applied, data signals D(S2) (DR1-DRn), (DG1-DGn), (DB1-DBn) from the R, G and B data lines (121R-12*n*R), (121G-12*n*G), (121B-12*n*B) constituting the first to the $n_{th}$ data lines 121 to 12*n* are applied to the R, G and B unit pixels (PR21-PR2*n*), (PG21-PG2*n*), (PB21-PB2*n*) of the pixels (P21-P2*n*) connected to the second gate line 112.

The EL elements constituting the R, G and B unit pixels (PR21-PR2*n*), (PG21-PG2*n*), (PB21-PB2*n*) of the pixels (P21-P2*n*) connected to the second gate line 112 are simultaneously driven by the driving currents corresponding to the data signals D (S2)(DR1-DRn), (DG1-DGn), (DB1-DBn).

By repeating such operations, when the scan signal Sm is finally applied to the $m_{th}$ gate line 11*m*, the EL elements constituting the R, G and B unit pixels (PRm1-PRmn), (PGm1-PGmn), (PBm1-PBmn) of the pixels (Pm1-Pmn) connected to the $m_{th}$ gate line 11*m* are simultaneously driven according to the R, G and B data signals D(Sm) (DR1-DRn), (DG1-DGn), (DB1-DBn) applied to the R, G and B data lines (121R-12*n*R), (121G-12*n*G), (121B-12*n*B).

Therefore, if the scan signals S1-Sm are sequentially applied from the first gate line 111 to the $m_{th}$ gate line 11*m*, the pixels (P11-P1*n*)-(Pm1-Pmn) connected to each gate line 111-11*m* are sequentially driven, thereby displaying a picture by driving the pixels during one frame 1F.

However, in the OLED having the above structure, each pixel is composed of three R, G and B unit pixels, and by each R, G and B unit pixel, the driving devices, that is, a switching thin film transistor and a driving thin film transistor and a capacitor, for driving the R, G and B EL elements, are arranged. Further, the data line and a power supply line for providing the data signal and the power supply (ELVDD) to each driving device are respectively arranged in each unit pixel.

Therefore, for each pixel, three data lines and three power supply lines are arranged, and at least six transistors, that is, three switching thin film transistors and three driving thin film transistors, and three capacitors are required. Further, for each pixel controlled by a light emitting control signal, a separate light emitting control line for providing the light emitting control signal is required. Hence, the conventional display device has problems in that, as a plurality of lines and a plurality of devices are arranged in each pixel, a circuit constitution is complex, and thus, a probability that a defect is generated is increased, thereby lowering yield.

Further, there is another problem that as the display device becomes high definition, each pixel area is reduced, and thus, it is difficult to arrange many devices in one pixel, and the aperture ratio is also reduced.

SUMMARY OF THE INVENTION

Therefore, in an exemplary embodiment of the present invention, is provided a pixel circuit of an OLED display suitable for high definition and a method of driving the same.

In addition, a pixel circuit of an OLED display capable of enhancing aperture ratio and yield, and a method of driving the same, is provided.

Further, a pixel circuit of an OLED display capable of simplifying a pixel configuration and wiring, and a method of driving the same, is provided.

In an exemplary embodiment according to the present invention, a display device is provided for displaying a predetermined color during an interval. The display device includes a plurality of pixels, each said pixel having at least two light emitting elements, each said light emitting element for emitting a corresponding color in the interval. Two said light emitting elements of two adjacent said pixels are time-divisionally driven by one active element, one of the two said light emitting elements being driven in a given period within the interval, thereby displaying the predetermined color during the interval.

The interval may be one frame, the given period may be a subframe, and the one frame may be divided into two subframes. The two said light emitting elements may be time-divisionally driven within the one frame. One of the two said light emitting elements may be driven in a first one of the subframes and the other one of the two said light emitting elements may be driven in a second one of the subframes.

The light emitting elements that emit different said corresponding colors may be substantially simultaneously emitted within one said frame, so that at least two different said corresponding colors may be emitted within the one said subframe. The light emitting element may be an FED or an R, G and B or W EL element. When the light emitting elements are EL elements, for each of the two said light emitting elements, a first electrode may be connected to the one active element and a second electrode may be connected to a ground voltage. The EL elements may be arranged in a stripe type or a delta type. The one active element may include at least one switching element for driving the two said light emitting elements. The at least one switching element may include one of a thin film transistor, a thin film diode, a diode and a TRS (triodic rectifier switch).

In another exemplary embodiment according to the present invention, a display device includes a plurality of pixels, each said pixel having at least two EL elements, each said EL element for emitting a corresponding one of colors within an interval. Two said EL elements of two adjacent said pixels are time-divisionally driven by one active element, one of the two said EL elements being driven in a given period within the interval. The EL elements emitting different said colors are substantially simultaneously driven within the given period to emit at least two different said colors.

The one active device may include a drive device commonly connected to the two said EL elements for driving the two said EL elements, and a sequential control device that controls the two said EL elements for time-divisionally controlling them based on a light emitting control signal. The drive device may include at least one switching transistor for switching data signals, at least one driving transistor for providing driving currents corresponding to the data signals to the two said EL elements, and a capacitor for storing the data signals. The drive device may further include a threshold voltage compensation device that compensates a threshold voltage of said at least one driving transistor.

The sequential control device may include a first thin film transistor having a first light emitting control signal provided to a gate, a source connected to the drive device, and a drain connected to an anode electrode in one of the two said EL elements, and a second thin film transistor having a second light emitting control signal provided to a gate, a source connected to the drive device, and a drain connected to an anode electrode in the other one of the two said EL elements. The sequential control device may alternatively include a first thin film transistor having a light emitting control signal provided to a gate, a source connected to the drive device, and a drain connected to an anode electrode in one of the two said EL elements, and a second thin film transistor having the light emitting control signal provided to a gate, a drain connected to the drive device, and a source connected to an anode electrode in the other one of the two said EL elements.

In yet another exemplary embodiment according to the present invention, an organic light emitting device display includes a plurality of pixels, each said pixel having at least two EL elements, each said EL element for emitting a corresponding color within an interval. Two said EL elements of two adjacent said pixels are time-divisionally driven by one active element, one of the two said EL elements being driven in a given period within the interval. The one active element includes a first thin film transistor having a gate connected to a gate line and one of a source and a drain connected to a data line, and a second thin film transistor having a gate connected to the other one of the source and the drain of the first thin film transistor and one of a source and a drain connected to a power supply line. A capacitor is connected between the gate and said one of the source and the drain of the second thin film transistor. The one active element also includes a third thin film transistor having one of a source and a drain connected to the other one of the source and the drain of the second thin film transistor, a first light emitting control signal applied to a gate, and the other one of the source and the drain connected to an anode electrode of one of the two said EL elements, and a fourth thin film transistor having one of a source and a drain connected to the other one of the source and the drain of the second thin film transistor, a second light emitting control signal applied to a gate, and the other one of the source and the drain connected to an anode electrode of the other one of the two said EL elements.

In yet another exemplary embodiment according to the present invention, an organic light emitting device display includes a plurality of pixels, each said pixel having at least two EL elements, each said EL element for emitting a corresponding color within an interval. Two said EL elements of two adjacent said pixels are time-divisionally driven by one active element, one of the two said EL elements being driven in a given period within the interval. The one active element includes a first thin film transistor having a gate connected to a gate line, and one of a source and a drain connected to a data line, and a second thin film transistor having a gate connected to the other one of the source and the drain of the first thin film transistor and one of a source and a drain connected to a power supply line. A capacitor is connected between the gate and said one of the source and the drain of the second thin film transistor. The one active element also includes a third thin film transistor having one of a source and a drain connected to the other one of the source and the drain of the second thin film transistor, a light emitting control signal applied to a gate, and the other one of the source and the drain connected to an anode electrode of one of the two said EL elements, and a fourth thin film transistor having one of a source and a drain connected to the other one of the source and the drain of the second thin film transistor, the light emitting control signal applied to a gate, and the other one of the source and the drain connected to the anode electrode of the other one of the two said EL elements.

In yet another exemplary embodiment according to the present invention, a display device for displaying a predetermined color during an interval. The display device includes a plurality of pixels, each said pixel having at least two light emitting elements, each said light emitting element for emitting a corresponding color in the interval. Some of the light emitting elements of two adjacent said pixels are grouped into a first light emitting element group, and remaining said light emitting elements of the two adjacent said pixels are grouped into a second light emitting element group. The first light emitting element group and the second light emitting element group are time-divisionally driven within the interval, thereby displaying the predetermined color during the interval.

The interval may be one frame, and the one frame may be divided into two subframes. The first light emitting element group and the second light emitting element group may be time-divisionally driven, the first light emitting element group being driven in one of the two subframes and the second light emitting element group being driven in the other one of the two subframes. White balance of the predetermined color may be made by adjusting a light emitting time of the light emitting elements in the first light emitting element group and the second light emitting element group. Each of the first light emitting element group and the second light emitting element group may include at least one said light emitting element from each of the two adjacent said pixels.

In yet another exemplary embodiment according to the present invention, a display device displays a predetermined color during an interval. The display device includes a plurality of pixels, each said pixel having at least two light emitting elements, each said light emitting element for emitting a corresponding color within the interval. Some of the light emitting elements of two adjacent said pixels are grouped into a first light emitting element group, and remaining said light emitting elements of the two adjacent said pixels are grouped into a second light emitting element group. The light emitting elements of the first light emitting element group or the second light emitting element group are driven during a given period within the interval, thereby displaying the predetermined color during the interval.

In yet another exemplary embodiment according to the present invention, an OLED display includes a plurality of gate lines, a plurality of data lines, a plurality of light emitting control lines and a plurality of power supply lines, and a plurality of pixels, each said pixel being connected to a corresponding said gate line, a corresponding said data line, at least one corresponding said light emitting control line, and a corresponding said power supply line. Each said pixel has at least two EL elements, each said EL element for emitting a corresponding color within an interval. Two said EL elements of two adjacent said pixels are time-divisionally driven by an active element, one of the two said EL elements being driven in a given period within the interval. The active element includes at least one switching transistor for switching data signals supplied from the corresponding said data line in response to a scan signal applied from the corresponding said gate line, at least one driving transistor for driving the EL elements using the data signals provided through said at least one switching transistor, and at least one thin film transistor that controls the two said EL elements to be time-divisionally driven, one of the two said EL elements being driven in the given period, in response to at least one light emitting control signal from said at least one corresponding said light emitting control line.

In yet another exemplary embodiment according to the present invention, an OLED display includes a plurality of gate lines, a plurality of data lines, a plurality of light emitting control lines and a plurality of power supply lines, and a plurality of pixels, each said pixel being connected to a corresponding said gate line, a corresponding said data line, a corresponding said light emitting control line, and a corresponding said power supply line. Each said pixel has at least two EL elements, each said EL element for emitting a corresponding color within an interval. Two said EL elements of two adjacent said pixels are time-divisionally driven by an active element, one of the two said EL elements being driven in a given period within the interval. The active element includes a first thin film transistor having a gate connected to the corresponding said gate line and one of a source and a drain connected to the corresponding said data line, and a second thin film transistor having a gate connected to the other one of the source and the drain of the first thin film transistor and one of a source and a drain connected to the corresponding said power supply line. A capacitor is connected between the gate and said one of the source and the drain of the second thin film transistor. The active element also includes a third thin film transistor having one of a source and a drain connected to the other one of the source and the drain of the second thin film transistor, a first light emitting control signal from said at least one corresponding said light emitting control line applied to a gate, and the of the one of the source and the drain connected to an anode electrode of one of the two said EL elements, and a fourth thin film transistor having one of a source and a drain connected to the other one of the source and the drain of the second thin film transistor, a second light emitting control signal from said at least one corresponding said light emitting control line applied to a gate, and the other one of the source and the drain connected to an anode electrode of the other one of the two said EL elements.

In yet another exemplary embodiment according to the present invention, an OLED display includes a plurality of gate lines, a plurality of data lines, a plurality of light emitting control lines and a plurality of power supply lines, and a plurality of pixels, each said pixel being connected to a corresponding said gate line, a corresponding said data line, a corresponding said light emitting control line, and a corresponding said power supply line. Each said pixel has at least two EL elements, each said EL element for emitting a corresponding color within an interval. Two said EL elements of two adjacent said pixels are time-divisionally driven by an active element, one of the two said EL elements being driven in a given period within the interval. The active element includes a first thin film transistor having a gate connected to the corresponding said gate line and one of a source and a drain connected to the corresponding said data line, and a second thin film transistor having a gate connected to the other one of the source and the drain of the first thin film transistor and one of a source and a drain connected to the corresponding said power supply line. A capacitor is connected between the gate and said one of the source and the drain of the second thin film transistor. The active element also includes a third thin film transistor having one of a source and a drain connected to the other one of the source and the drain of the second thin film transistor, a light emitting control signal from the corresponding said light emitting control line applied to a gate, and the other one of the source and the drain connected to an anode of one of the two said EL elements, and a fourth thin film transistor having one of a source and a drain connected to the other one of the source and the drain of the second thin film transistor, the light emitting control signal applied to a gate, and the other one of the source and the drain connected to an anode of the other one of the two said EL elements.

In yet another exemplary embodiment according to the present invention, an OLED display includes a plurality of gate lines, a plurality of data lines, a plurality of light emitting control lines and a plurality of power supply lines, and a pixel portion including a plurality of pixels, each said pixel being connected to a corresponding said gate line, a corresponding said data line, a corresponding said light emitting control line, and a corresponding said power supply line. The OLED display also includes a gate line driving circuit for providing a plurality of scan signals to the plurality of gate lines, a data line driving circuit for providing R, G and B data signals to the plurality of data lines, and a light emitting control signal generation circuit for providing light emitting control signals to the plurality of light emitting control lines. Each said pixel of the pixel portion includes R, G and B EL elements. Some said EL elements among the R, G and B EL elements of two adjacent said pixels are grouped into a first light emitting element group, and remaining said EL elements of the two adjacent said pixels are grouped into a second light emitting element group. The light emitting elements in the first light emitting element group or the second light emitting element group are driven corresponding to the data signals in response to a corresponding said light emitting control signal from the corresponding said light emitting control line during a given period within an interval.

In yet another exemplary embodiment according to the present invention, is provided a method of driving a display device having a plurality of gate lines, a plurality of data lines, a plurality of light emitting control lines and a plurality of power supply lines, and a plurality of pixels, each said pixel connected to a corresponding said gate line, a corresponding said data line, a corresponding said light emitting control line, and a corresponding said power supply line. Each said pixel has at least R, G and B EL elements. The method includes grouping some said EL elements of said at least R, G and B EL elements of two adjacent said pixels into a first light emitting element group, and grouping remaining said EL elements of the two adjacent said pixels into a second light emitting element group; and time-divisionally driving the first light emitting element group and the second light emitting element group within an interval.

For a method of driving the display device, the light emitting elements of at least one of the first light emitting element group and the second light emitting element group may sequentially or collectively emit light.

In yet another exemplary embodiment according to the present invention, is provided a method of driving a display device including a plurality of gate lines, a plurality of data lines, a plurality of light emitting control lines and a plurality of power supply lines, and a plurality of pixels, each said pixel connected to a corresponding said gate line, a corresponding data line, a corresponding said light emitting control line, and a corresponding said power supply line. Each said pixel has at least R, G and B EL elements. The method includes grouping some said EL elements of said at least R, G and B EL elements of two adjacent said pixels into a first light emitting element group and grouping remaining said EL elements of the two adjacent said pixels into a second light emitting element group. The method also includes writing data for driving the EL elements at least one of the first light emitting element group and the second light emitting element group through the corresponding said data line in response to a scan signal provided from the corresponding said gate line during a first period within a given period of an interval, and collectively light emitting the EL elements of at least one of the first light emitting element group and the second light emitting element group using the written data during a second period within the given period of the interval. The EL elements of at least one of the first light emitting element group and the second light emitting element group are sequentially driven per the given period of the interval.

The present invention will be better understood from the following detailed description of the exemplary embodiment thereof taken in conjunction with the accompanying drawings, and its scope will be pointed out in the appended claims.

BRIEF DESCRIPTION OF THE DRAWINGS

The above and other features of the present invention will become more apparent to those of ordinary skill in the art by describing in detail certain exemplary embodiments thereof with reference to the attached drawings in which.

DETAILED DESCRIPTION

Figure 1:
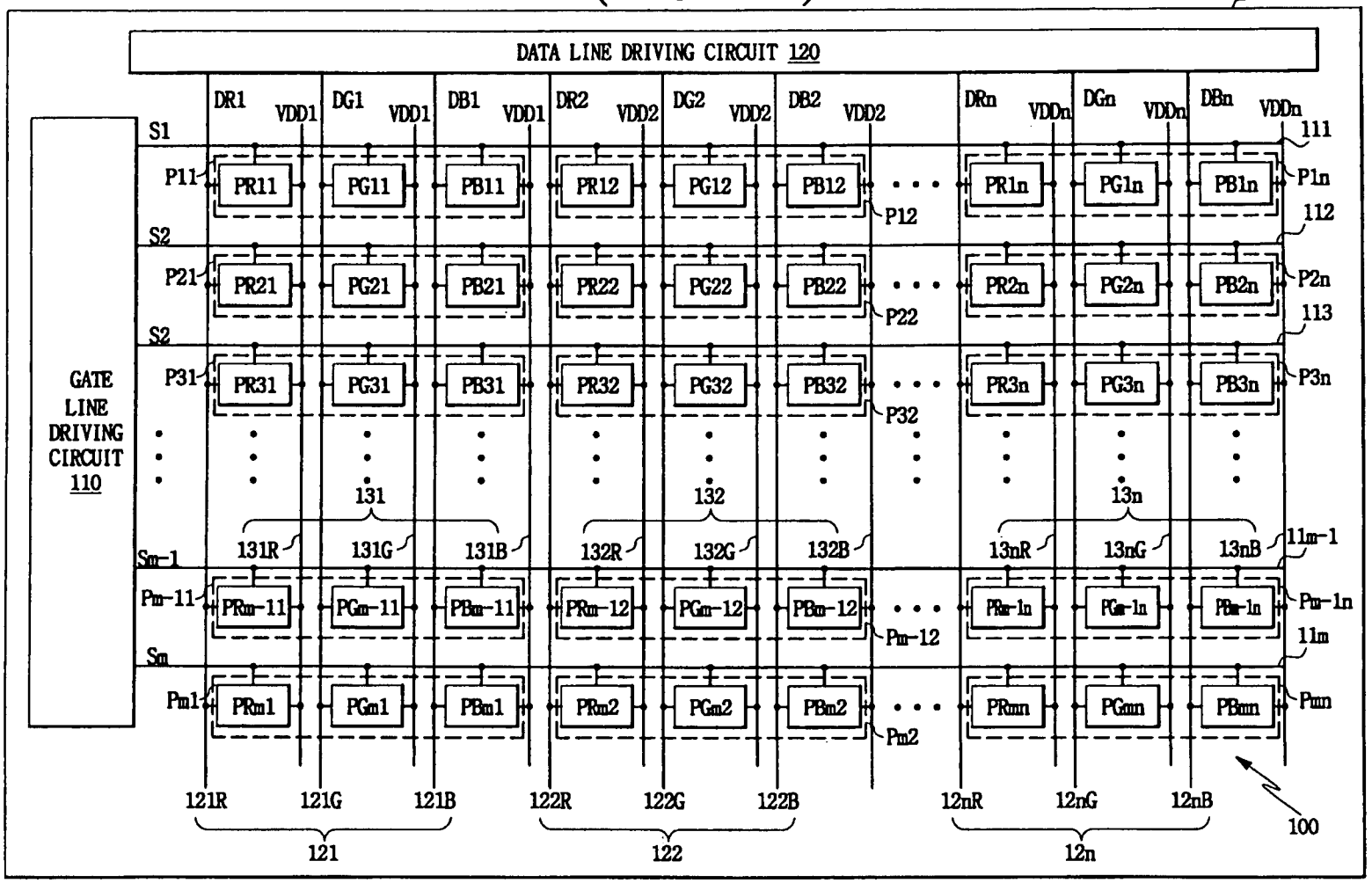
FIG. 1 (PRIOR ART)
FIG. 1 is a configuration diagram of a conventional OLED display.
Figure 2:
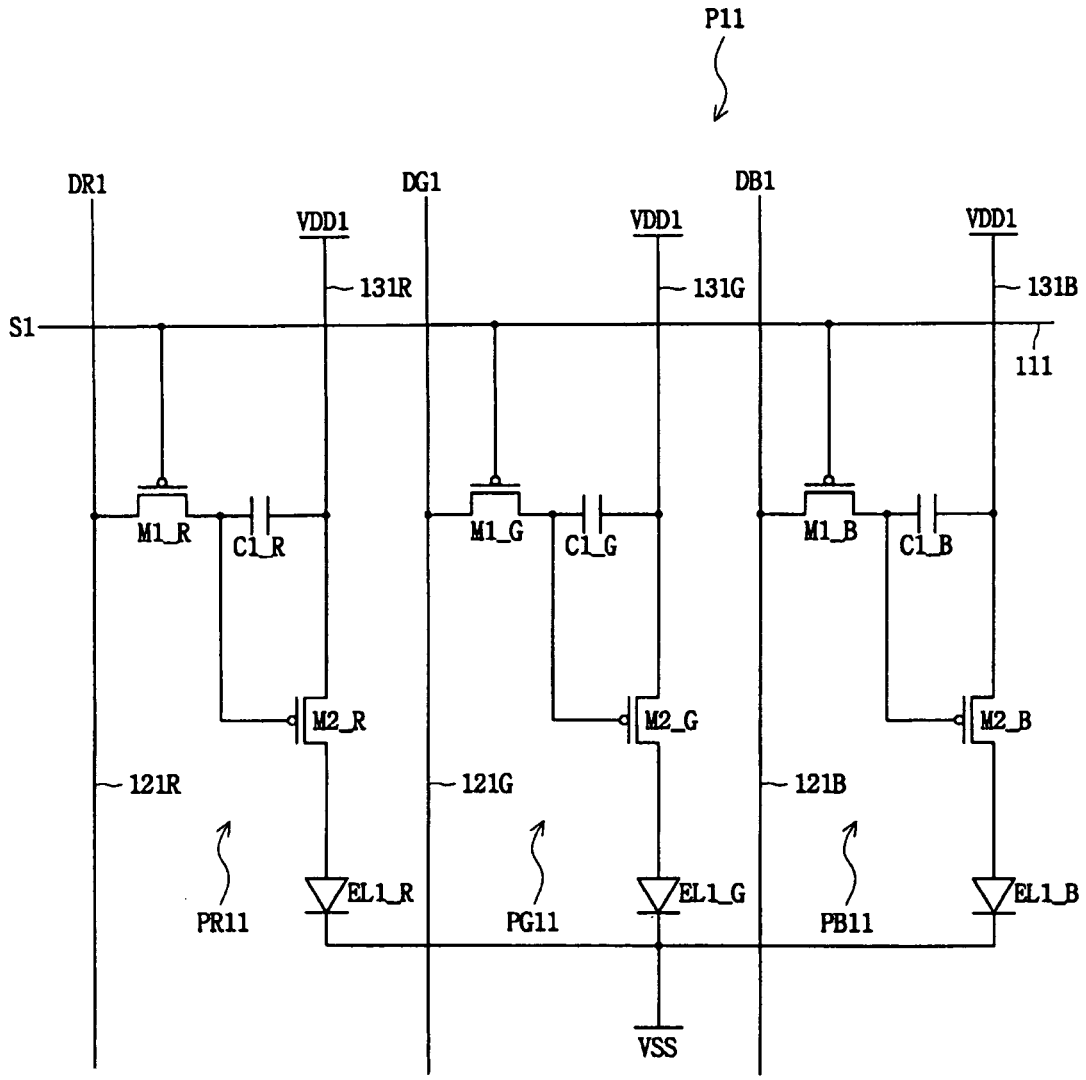
FIG. 2 (PRIOR ART)
FIG. 2 is a configuration diagram of a pixel circuit of the OLED display of FIG. 1.

The present invention will now be described more fully hereinafter with reference to the accompanying drawings, in which certain exemplary embodiments of the present invention are shown. This invention may, however, be embodied in different forms and should not be construed as being limited to the embodiments set forth herein. Like reference numerals/characters designate like elements throughout the specification.

Figure 4:
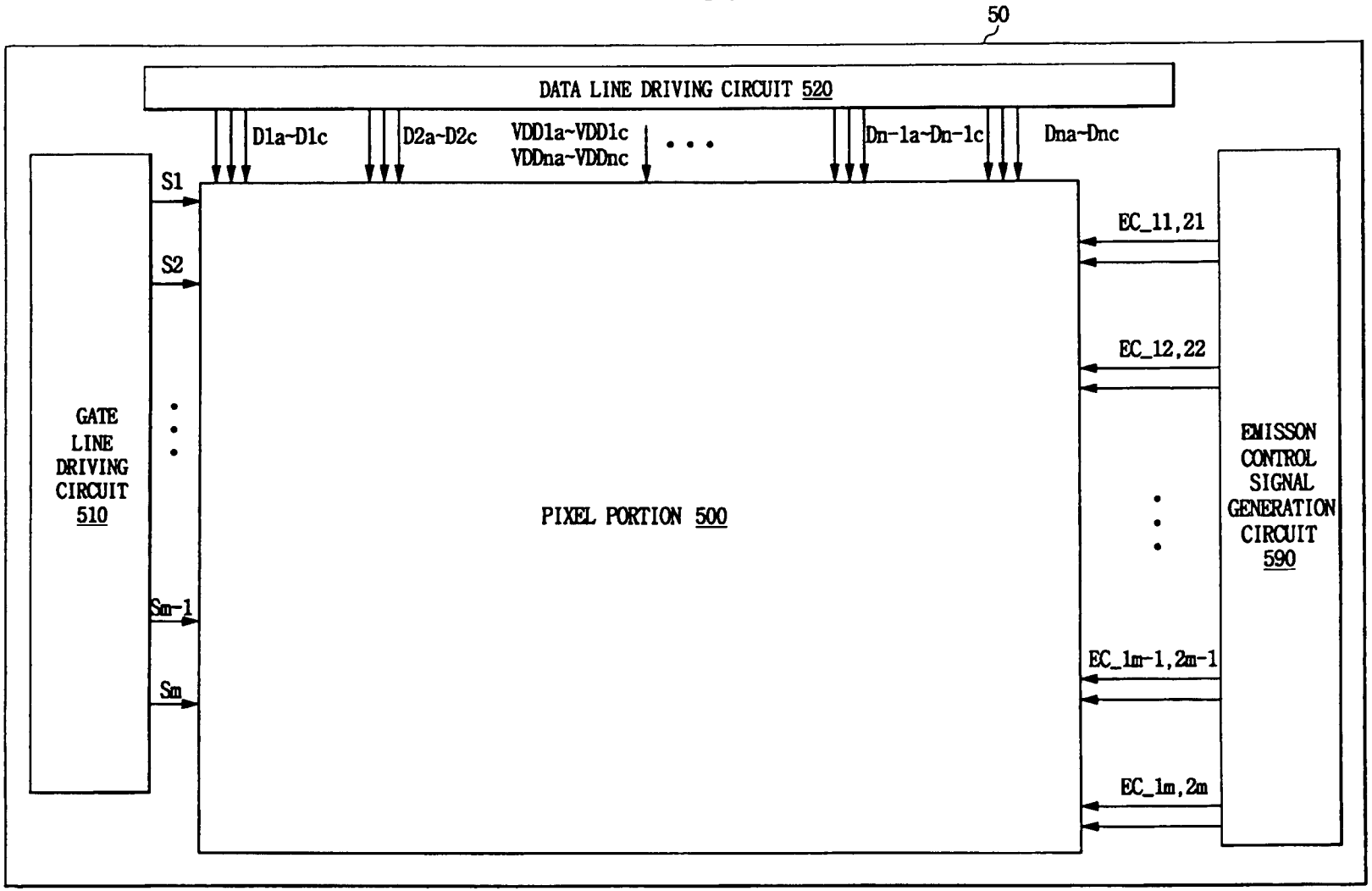
FIG. 4 is a block configuration diagram of an OLED display according to a first exemplary embodiment of the present invention.

Referring to FIG. 4, an OLED display 50 includes a pixel portion 500, a gate line driving circuit 510, a data line driving circuit 520, and a light emitting control signal generation circuit 590. The gate line driving circuit 510 sequentially generates scan signals S1-Sm to the gate lines of the pixel portion 500 during one frame. The data line driving circuit 520 sequentially provides R, G and B data signals (D1*a*-D1*c*)~(Dna-Dnc) to the data lines of the pixel portion 500 each time the scan signal is applied during one frame. The light emitting control signal generation circuit 590 sequentially generates the light emitting control signals (EC_11, 21)-(EC_1*m*, 2*m*), for controlling the light emitting of the R, G and B EL elements, to the light emitting control lines each time the scan signal is applied during one frame.

Figure 6:
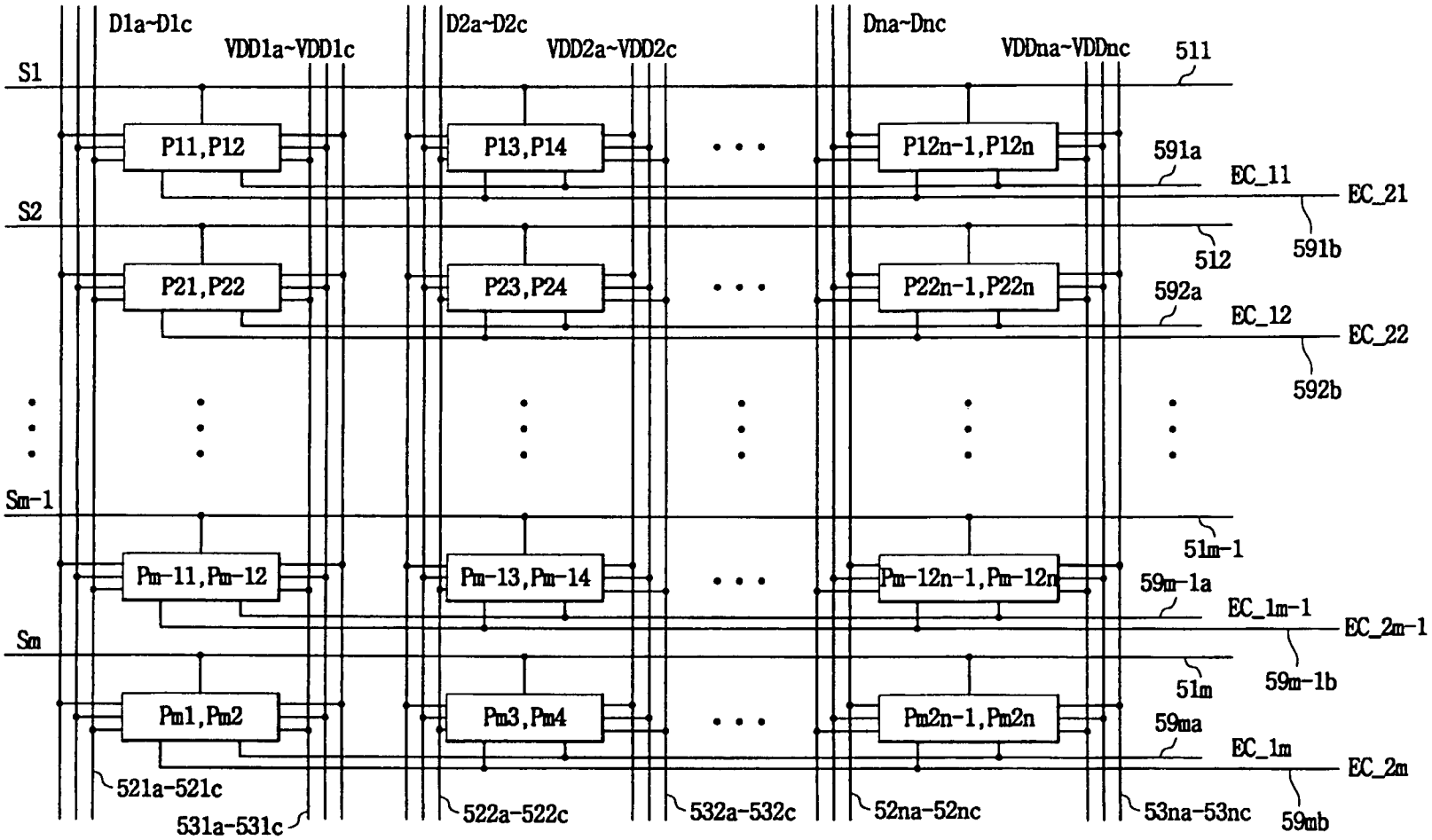
FIG. 6 is a configuration diagram of a pixel portion of the OLED display of FIG. 4.

Referring now to FIG. 6, the pixel portion 500 includes a plurality of gate lines 511-51*m* to which respective scan signals S1-Sm from the gate line driving circuit 510 are provided, and a plurality of data lines (521*a*-521*c*)~(52*na*-52*nc*) to which respective data signals (D1*a*-D1*c*)~(Dna-Dnc) from the data line driving circuit 520 are applied. The pixel portion 500 also includes a plurality of light emitting control lines (591*a*, 591*b*)~(59*ma*, 59*mb*) to which respective light emitting control signals (EC_11, EC_21)~(EC_1*m*, 2*m*) from the light emitting control signal generation circuit 590 are provided, and a plurality of power supply lines (531*a*-531*c*)~(53*na*-53*nc*) to which respective power supply voltages (VDD1*a*-VDD1*c*)~(VDDna-VDDnc) are provided.

The pixel portion 500 also includes a plurality of pixels connected to the plurality of gate lines (511-51*m*), the plurality of data lines (521*a*-521*c*)~(52*na*-52*nc*), the plurality of light emitting control lines (591*a*, 591*b*-59*ma*, 59 *mb*), and the plurality of power supply lines (531*a*-531*c*)~(53*na*-53*nc*), and arranged in a matrix form. Two adjacent pixels (P11, P12)~(Pm2*n*-1, Pm2*n*) along the gate line among the plurality of pixels P11-Pm2*n* are connected to a corresponding one of the plurality of gate lines 511-51*m*, three corresponding data lines among the plurality of data lines (521*a*-521*c*)~(52*na*-52*nc*), two corresponding light emitting control lines among the plurality of light emitting control lines (591*a*-591*b*)~(59*ma*-59*mb*), and three corresponding power supply lines among the plurality of power supply lines (531*a*-531*c*)~(53*na*-53*nc*).

For example, two adjacent pixels P11, P12 are connected to the gate line 511 that provides the first scan signal S1 among the plurality of gate lines 511-51*m*, the data lines 521*a*-521*c* that provide the data signals D1*a*-D1*c* among the plurality of data lines (521*a*-521*c*)~(52*na*-52*nc*), the light emitting control lines 591*a*, 591*b* that generate light emitting control signals EC_11, EC_21 among the plurality of light emitting control lines (591*a*, 591*b*)~(59*ma*, 59*mb*), and the power supply lines 531*a*-531*c* among the plurality of power supply lines (531*a*-531*c*)~(53*na*-53*nc*).

Figure 8:
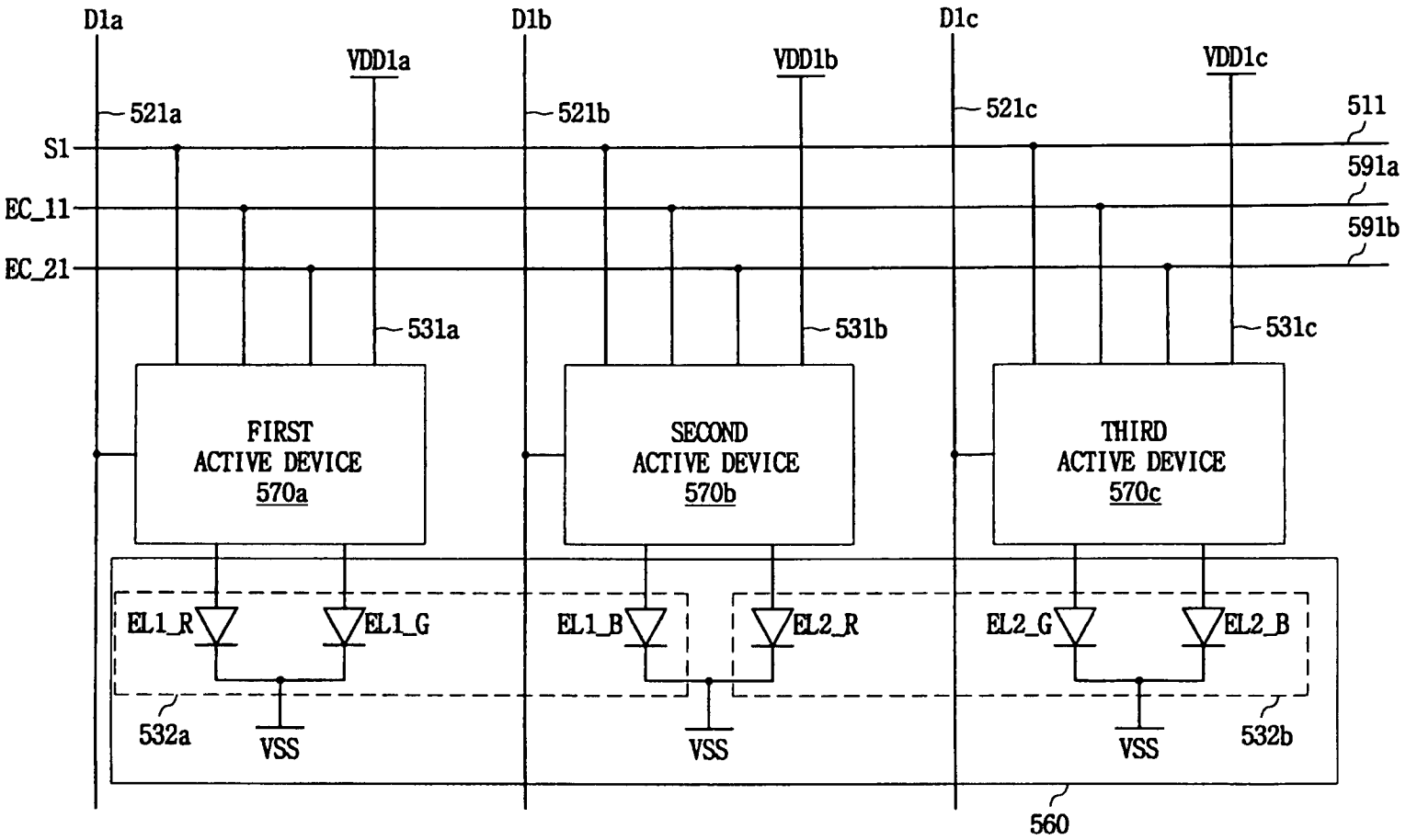
FIG. 8 is a block configuration diagram of a pixel circuit of the OLED display of FIG. 4.

FIG. 8 is a block configuration diagram schematically illustrating a pixel circuit of two adjacent pixels, for the OLED display according to the first exemplary embodiment of the present invention shown in FIG. 6. FIG. 8 shows two adjacent pixels P11, P12 among the plurality of pixels for illustrative purposes only with the understanding that the other pairs of adjacent pixels shown in FIG. 6 have substantially the same configuration and operate in substantially the same manner.

Referring to FIG. 8, two adjacent pixels P11, P12 includes a display element 560 having R, G and B EL elements (EL1_R, EL1_G, EL1_B) 532*a*, (EL2_R, EL2_G, EL2_B) 532*b*, and first to third active devices ("active elements") 570*a*-570*c* for driving the R, G and B EL elements (EL1_R, EL1_G, EL1_B), (EL2_R, EL2_G, EL2_B). The first active device 570*a* is connected to the gate line 511, the data line 521*a*, the light emitting control lines 591*a*, 591*b* and the power supply line 531*a*. The second active device 570*b* is connected to the gate line 511, the data line 521*b*, the light emitting control lines 591*a*, 591*b*, and the power supply line 531*b*. The third active device 570*c* is connected to the gate line 511, the data line 521*c*, the light emitting control lines 591*a*, 591*b* and the power supply line 531*c*.

Further, between the first active device 570*a* and the ground VSS, anode and cathode electrodes of R and G EL elements EL1_R, EL1_G among the R, G and B EL elements EL1_R, EL1_G, EL1_B of the first pixel P11 are connected. Between the second active device 570*b* and the ground, anode and cathode electrodes of a B EL element EL1_B of the first pixel P11 and an R EL element EL2_R among the R, G and B EL elements EL2_R, EL2_G, EL2_B of the second pixel P12 are connected. Between the third active device 570*c* and the ground, the anode and cathode electrodes of the G and B EL elements EL2_G, EL2_B of the second pixel P12 are connected.

In the pixel circuit having the configuration as described above, two EL elements (EL1_R, EL1_G), (EL1_B, EL2_R) or (EL2_G, EL2_B) among R, G and B EL elements (EL1_R, EL1_G, EL1_B) 532*a*, (EL2_R, EL2_G, EL2_B) 532*b* of two adjacent pixels P11, P12 share a corresponding one of the active devices 570*a*, 570*b* and 570*c*. Therefore, two EL elements (EL1_R, EL1_G), (EL1_B, EL2_R) or (EL2_G, EL2_B) that share the corresponding one of the active devices 570*a*, 570*b* and 570*c* are time-divisionally sequentially driven by subframes constituting one frame.

In other words, in the R, G and B EL elements (EL1_R, EL1_G, EL1_B) 532*a*, (EL2_R, EL2_G, EL2_B) 532*b* of two pixels P11, P12, the EL elements EL1_R, EL1_B, EL2_G among R, G and B EL elements (EL1_R, EL1_G, EL1_B), (EL2_R, EL2_G, EL2_B) sharing one active device 570*a*, 570*b* or 570*c* are grouped into a first EL element group, and the remaining EL elements EL1_G, EL2_R, EL2_B are grouped into a second EL element group. Therefore, in one subframe, the EL elements EL1_R, EL1_B, EL2_G belonging to the first EL element group of two EL element groups are substantially simultaneously driven, and then the EL elements EL1_G, EL2_R, EL2_B belonging to the second EL element group are substantially simultaneously driven in the next subframe.

Therefore, according to the first exemplary embodiment of the present invention, one frame is divided into two subframes, and two light emitting elements (EL1_R, EL1_G), (EL1_B, EL2_R), (EL2_G, EL2_B) among R, G and B EL elements (EL1_R, EL1_G, EL1_B), (EL2_R, EL2_G, EL2_B) of two adjacent pixels are respectively driven time-divisionally by each active device (570*a*, 570*b*, 570*c*) by subframes. That is, the light emitting elements EL1_R, EL1_B and EL2_G are substantially simultaneously driven in one subframe by the respective active devices 570*a*, 570*b*, 570*c* and in the next frame, the light emitting elements EL1_G, EL2_R and EL2_B are substantially simultaneously driven by respective active devices 570*a*, 570*b*, 570*c*, thereby driving the adjacent pixels P11, P12 and displaying a predetermined color.

Figure 10:
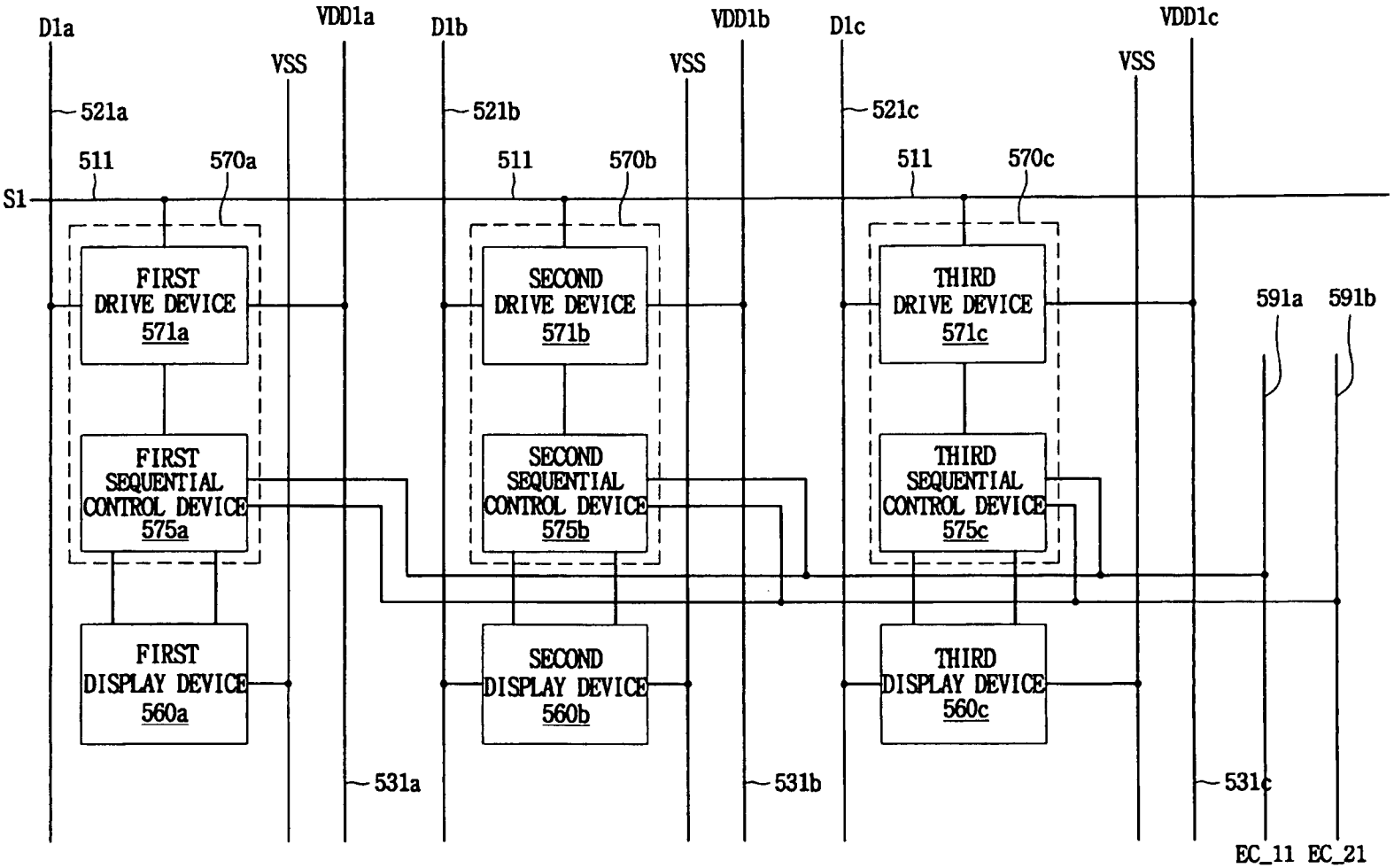
FIG. 10 is a detailed block configuration diagram of the pixel circuit of FIG. 8.
Figure 12:
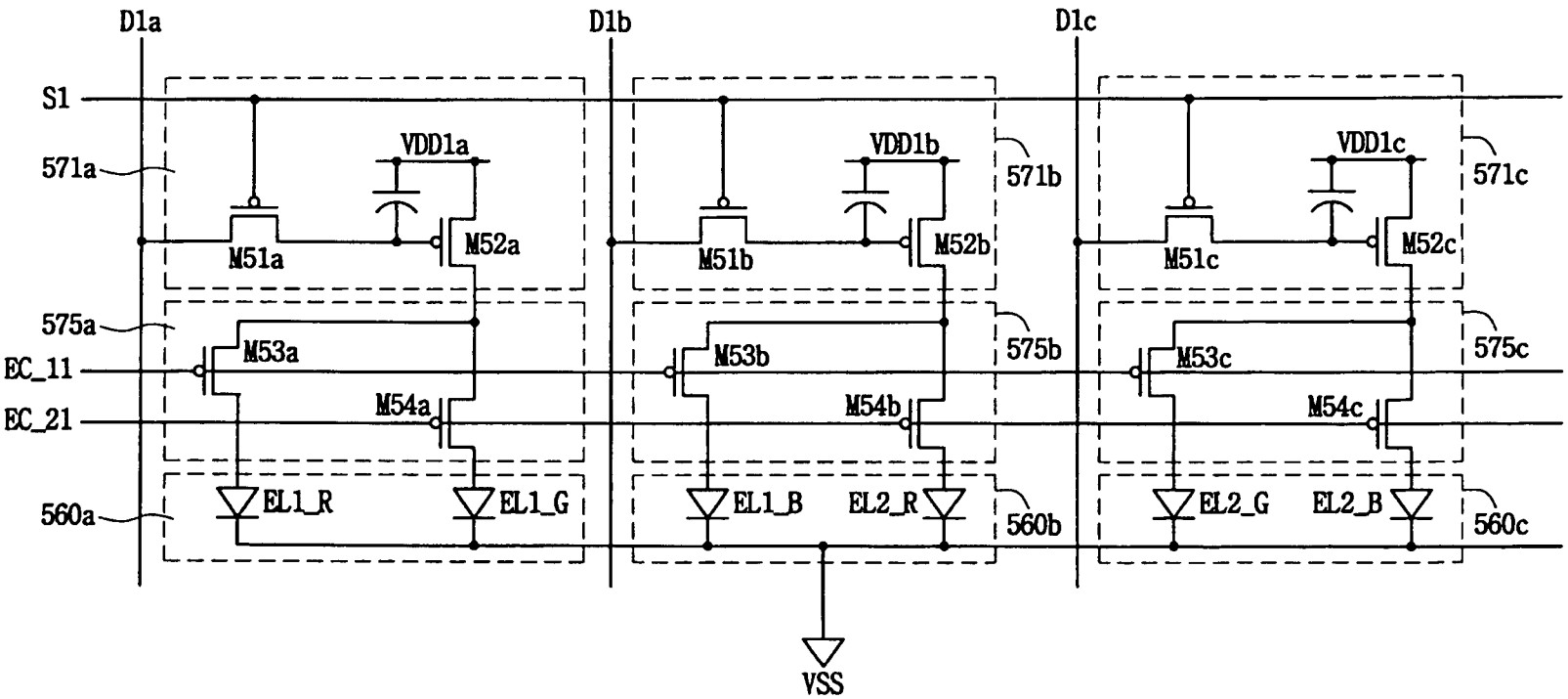
FIG. 12 illustrates a pixel circuit that can be applied as the pixel circuit of FIG. 10.

FIG. 10 illustrates a block configuration diagram of a pixel circuit in the OLED display with a sequential driving method according to the first exemplary embodiment of the present invention of FIG. 8, and FIG. 12 illustrates a pixel circuit that can be applied as the pixel circuit of FIG. 10. The pixel circuits of FIG. 10 and FIG. 12 illustrate a detailed example of the pixel circuit for sequentially driving the R, G and B EL elements EL1_R, EL1_G, EL1_B, EL2_R, EL2_G, EL2_B of two adjacent pixels P11, P12 by time division during one frame.

Referring to FIG. 10 and FIG. 12, the first active device 570*a* for driving a first display device 560*a* includes a first drive device 571*a* and a first sequential control device 575*a*. The first drive device 571*a* includes a first P-type thin film transistor M51*a* having a gate connected to the gate line 511 and a source connected to the data line 521*a*; a second P-type thin film transistor M52*a* having a source connected to the power supply line 531*a* and a gate connected to a drain of the first thin film transistor; and a capacitor C51*a* connected between the power supply line 531*a* and the gate of the second thin film transistor M52*a*.

The first sequential control device 575*a* includes a third P-type thin film transistor M53*a* having the light emitting control signal EC_11 from the light emitting control line 591*a* applied to a gate, and a source connected to a drain of the second thin film transistor M52*a*; and a fourth P-type thin film transistor M54*a* having the light emitting control signal EC_21 from the light emitting control line 591*b* applied to a gate, and a source connected to the drain of the second thin film transistor M52*a*.

The first display device 560*a* includes an R EL element EL1_R of the first pixel P11 having an anode electrode and a cathode electrode respectively connected to a drain of the third thin film transistor M53*a* and the ground; and a G EL element EL1_G of the first pixel P11 having an anode electrode and a cathode electrode respectively connected to a drain of the fourth thin film transistor M54*a* and the ground.

The second active device 570*b* for driving a second display device 560*b* includes a second drive device 571*b* and a second sequential control device 575*b*. The second drive device 571*b* includes a first P-type thin film transistor M51*b* having a gate connected to the gate line 511 and a source connected to the data line 521*b*; and a second P-type thin film transistor M52*b* having a source connected to the power supply line 531*b* and a gate connected to a drain of the first thin film transistor M51*b*; and a capacitor connected between the power supply line 531*b* and the gate of the second thin film transistor M52*b*.

The second sequential control device 575*b* includes a third P-type thin film transistor M53*b* having the light emitting control signal EC_11 from the light emitting control line 591*a* applied to a gate, and a source connected to a drain of the second thin film transistor M52*b*; and a fourth P-type thin film transistor M54*b* having the light emitting control signal EC_21 from the light emitting control line 591*b* applied to a gate, and a source connected to the drain of the second thin film transistor M52*b*.

The second display device 560*b* includes a B EL element EL1_B of the first pixel P11 having an anode electrode and a cathode electrode respectively connected to a drain of the third thin film transistor M53*b* and the ground; and an R EL element EL2_R of the second pixel P12 having an anode and a cathode respectively connected to a drain of the fourth thin film transistor M54*b* and the ground.

The third active device 570*c* for driving a third display device 560*c* includes a third drive device 571*c* and a third sequential control device 575*c*. The third drive device 571*c* includes a first P-type thin film transistor M51*c* having a gate connected to the gate line 511 and a source connected to the data line 521*c*; and a second P-type thin film transistor M52*c* having a source connected to the power supply line 531*c* and a gate connected to a drain of the first thin film transistor M51*c*; and a capacitor C51*c* connected between the power supply line 531*c* and the gate of the second thin film transistor M52*c*.

The third sequential control device 575*c* includes a third P-type thin film transistor M53*c* having the light emitting control signal EC_11 from the light emitting control line 591*a* applied to a gate, and a source connected to a drain of the second thin film transistor M52*c*; and a fourth P-type thin film transistor M54*c* having the light emitting control signal EC_21 from the light emitting control line 591*b* applied to a gate, and a source connected to the drain of the second thin film transistor M52*c*.

The third display device 560*c* includes a G EL element EL2_G of the second pixel P12 having an anode electrode and a cathode electrode respectively connected to a drain of the third thin film transistor M53*c* and the ground; and a B EL element EL2_B of the second pixel P12 having an anode and a cathode respectively connected to a drain of the fourth thin film transistor M54*c* and the ground.

A method of driving a pixel circuit in the OLED display according to the first exemplary embodiment of the present invention will now be described as follows.

Figure 3:
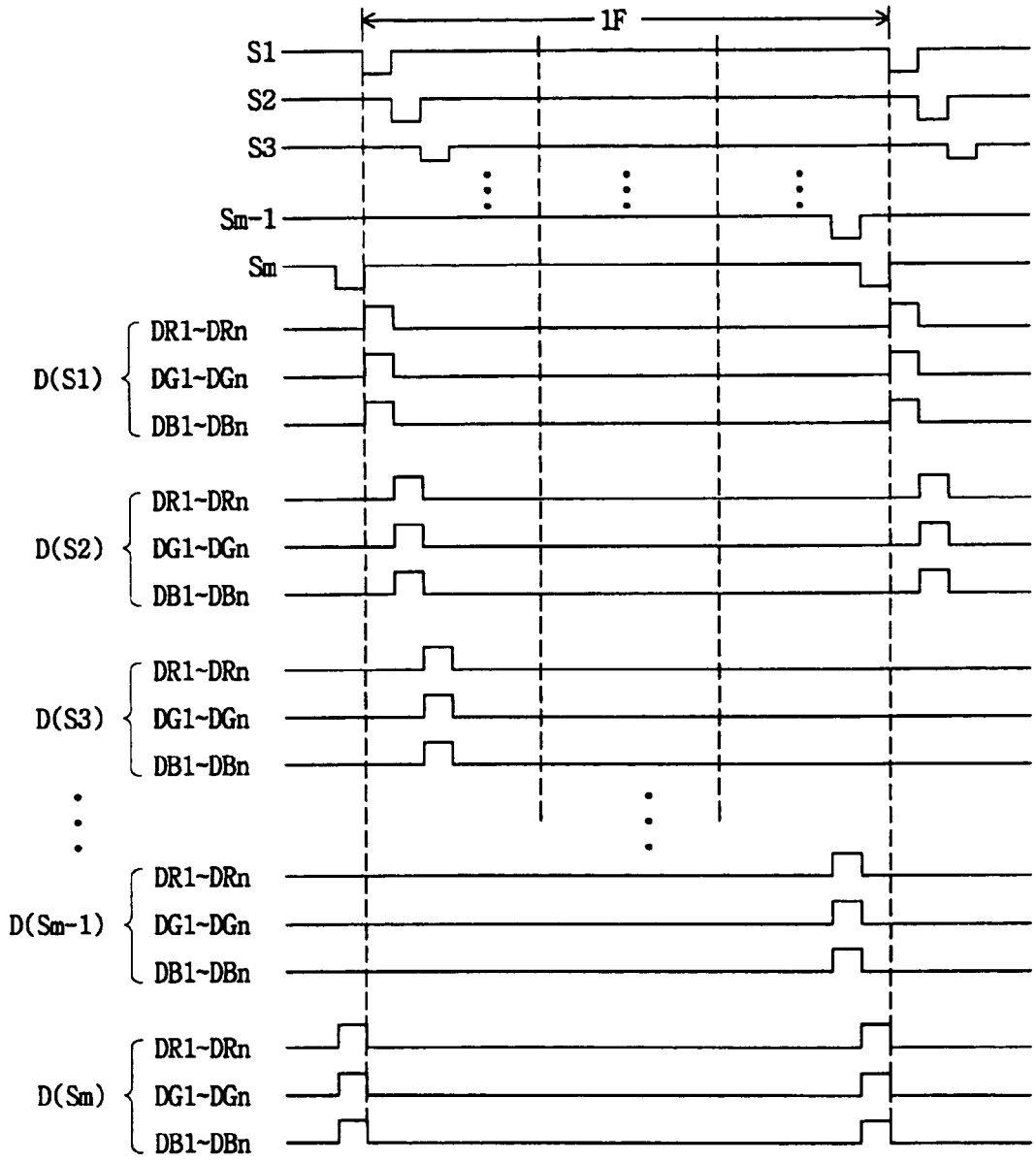
FIG. 3 (PRIOR ART)
FIG. 3 is an operational waveform of the OLED display of FIG. 1.

As shown in FIG. 3, conventionally, each one of scan signals S1-Sm from the gate line driving circuit 110 is sequentially applied to a plurality of gate lines, so that m scan signals are applied thereto during one frame. And whenever each of the scan signals S1-Sm is applied, R, G and B data signals (DR1-DRn), (DG1-DGn), (DB1-DBn) from the data line driving circuit 120 are simultaneously applied to R, G and B data lines to drive the pixels.

On the other hand, according to the described embodiment of the present invention, one frame is divided into two subframes, and during each subframe, the scan signal from the gate line driving circuit 510 is applied to each gate line, and thus, 2*m* scan signals are applied during one frame. In case of two adjacent pixels, i.e., the first and second pixels P11, P12, when the scan signal S1 is applied to the first gate line 511 during the first subframe, the switching transistors M51*a*-M51*c* of the first to third drive devices 571*a*-571*c* are turned on, and the R data signal D1*a* and the B data signal D1*b* of the first pixel P11 and the G data signal D1*c* of the second pixel P12 are provided to the driving transistors M52*a*-M52*c* from the data lines 521*a*-521*c*. Further, in the first to third sequential control devices 575*a*-575*c*, since the thin film transistors M53*a*-M53*c* are turned on by the light emitting control signal EC_11 provided from the light emitting control line 591*a*, the R EL element EL1_R and B EL element EL1_B of the first pixel and the G EL element EL2_G of the second pixel are substantially simultaneously driven corresponding to the R data signal D1*a* and the B data signal D1*b* of the first pixel P11 and the G data signal D1*c* of the second pixel P12.

Next, during the second subframe, the scan signal S1 is applied to the first gate line 511, so that the G data signal D1*a* of the fist pixel P11 and the R data signal D1*b* and the B data signal D1*c* of the second pixel P12 are provided from the data lines 521*a*-521*c* to the driving transistors M52*a*-M52*c*. Further, in the first to third sequential drive devices 575*a*-575*c*, the thin film transistors M54*a*-M54*c* are turned on by the light emitting control signal EC_21 provided from the light emitting control line 591*b*, so that the G EL element EL1_G of the first pixel P11 and the R EL element EL2_R and the B EL element EL2_B of the second pixel P12 are substantially simultaneously driven corresponding to the G data signal D1*a* of the first pixel P11 and the R data signal D1*b* and the B data signal D1*c* of the second pixel P12.

As such, by grouping R, G and B EL elements constituting two adjacent pixels into two groups, and driving the EL elements belonging to each group during a corresponding subframe of one frame, the R, G and B EL elements of the two pixels can be time-divisionally driven during one frame. That is, referring to FIG. 12, by grouping EL1_R, EL1_B, EL2_G among the R, G and B EL elements (EL1_R, EL1_G, EL1_B), (EL2_R, EL2_G, EL2_B) of the first and second pixels (P11, P12) into the first group, and EL1_G, EL2_R, EL2_B into the second group, the first group of EL elements (EL1_R, EL1_B, EL2_G) during the first subframe, and the second group of EL elements (EL1_G, EL2_R, EL2_B) during the second subframe are driven to display the picture. According to the present invention, since the EL elements having different colors simultaneously emit light during one subframe, two or more different colors emit light within one subframe.

Therefore, according to the pixel circuit in the first exemplary embodiment of the present invention, the active devices 570*a*-570*c* are shared by grouping the R, G and B EL elements of two adjacent pixels by two, thereby simplifying the circuit configuration.

Figure 13:
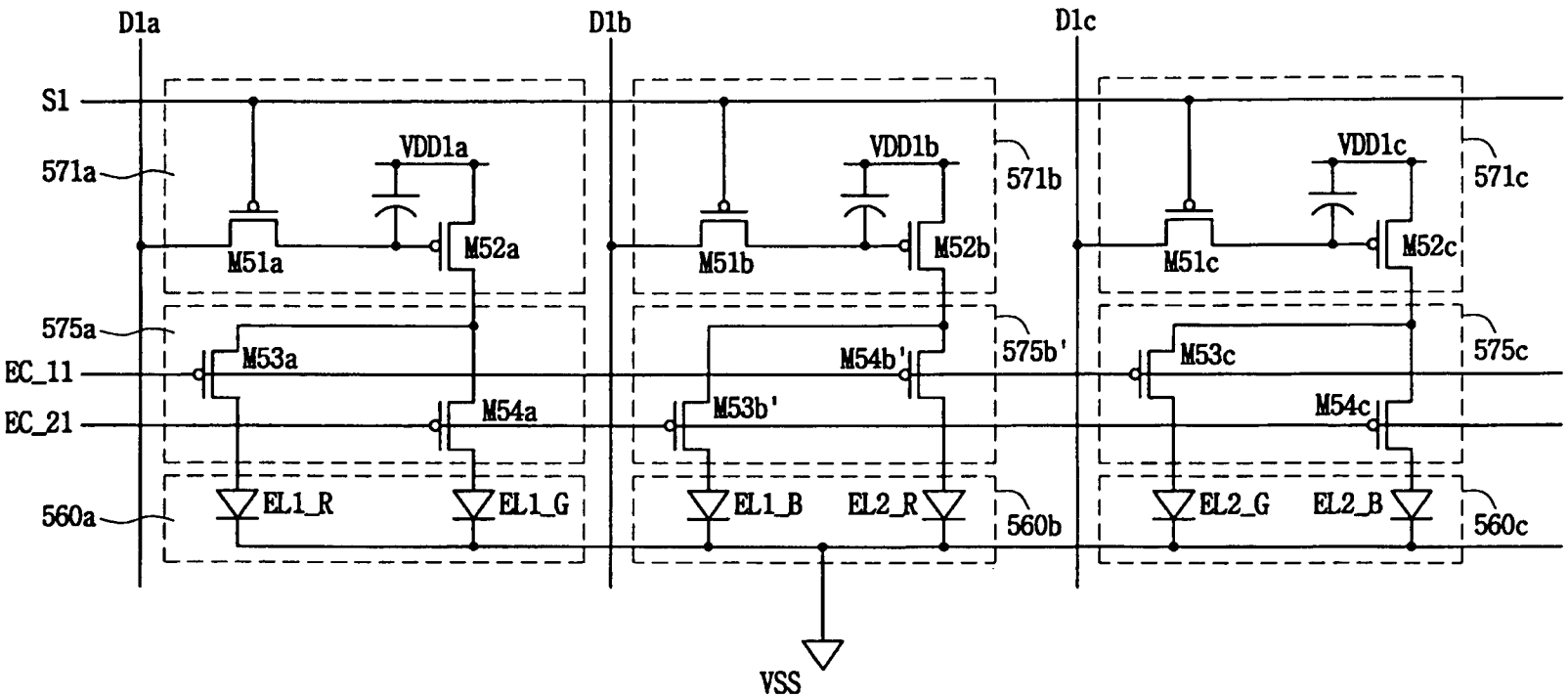
FIG. 13 illustrates another pixel circuit that can be applied as the pixel circuit of FIG. 10.

FIG. 13 has almost the same configuration as the detailed circuit of the pixel portion shown in FIG. 12. It can be seen in FIG. 13 that a second sequential control device 575*b*' is configured slightly differently from that of the second sequential control device 575*b* of FIGS. 11 and 12, while the rest of the pixel circuit elements are substantially the same. The second sequential control device 575*b*' has a third P-type thin film transistor M53*b*' having the light emitting control signal EC_21 from the light emitting control line 591*b* applied to a gate, and a source connected to a drain of the second thin film transistor M52*b*; and a fourth P-type thin film transistor M54*b*' having the light emitting control signal EC_11 from the light emitting control line 591*a* applied to a gate, and a source connected to the drain of the second thin film transistor M52*b*.

Hence, the R EL element EL1_R of the first pixel P11 and the R and G EL elements EL2_R, EL2_G of the second pixel P12 are grouped into the first group of EL elements, and the G and B EL elements EL1_G, EL1_B of the first pixel P11 and the B EL element EL2_B of the second pixel P12 are grouped into the second group of EL elements. Therefore, in the first subframe of one frame, the first group of EL elements, the R EL element EL1_R of the first pixel P11 and the R and G EL element EL2_R, EL2_G of the second pixel P12, are substantially simultaneously driven. Then in the second subframe, the second group of EL elements, the G and the B EL element EL1_G, EL1_B of the first pixel P11 and the B EL element EL2_B of the second pixel P12, are substantially simultaneously driven.

While FIGS. 12 and 13 only illustrate grouping of the R, G and B EL elements of the first and second pixels P11, P12 arranged on the same first gate line, for those adjacent pixels as shown in FIG. 6, the EL elements of two adjacent pixels are grouped into the first and second groups in substantially the same manner as described above.

Figure 15:
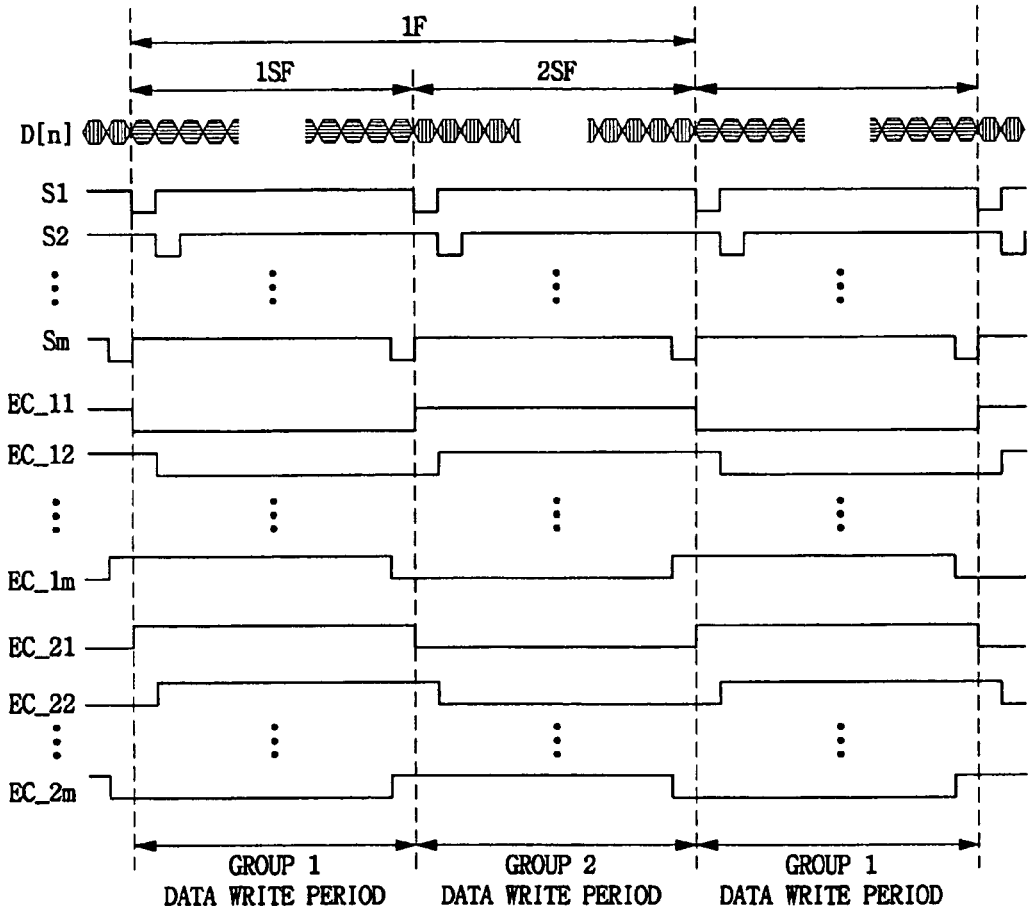
FIG. 15 illustrates an operational waveform diagram where the OLED display of FIG. 4 is driven in a sequential light emitting driving method.

FIG. 15 is an operational waveform diagram for illustrating a method of sequentially driving the OLED display of FIG. 4 by time division, which shows an operational waveform diagram of the sequential light emitting method that sequentially light emit the EL elements by scan line within each subframe. A method of driving the OLED in the sequential light emitting method will be described as follows with reference to the operational waveform diagram of FIG. 15.

First, during a first subframe 1SF of one frame 1F, when the scan signal S1 is applied to the first gate line 511 from the gate line driving circuit 510, the first gate line 511 is driven. Further, the data signals for driving the EL elements belonging to the first group among the R, G and B EL elements of the pixels P11-P12*n* connected to the first gate line 511 are provided to the corresponding driving transistors as the data signals (D1*a*-D1*c*)~(Dna-Dnc) from the data line driving circuit 520.

Here, when the light emitting control signals EC_11, EC_21 of low and high states are respectively applied through the light emitting control lines 591*a*, 591*b* from the light emitting control signal generation circuit 590, the thin film transistors for controlling the EL elements belonging to the first group among the thin film transistors constituting the sequential control devices are turned on, so that the driving currents corresponding to the data signals (D1*a*-D1*c*)~(Dna-Dnc) are provided to drive the EL elements of the first group.

Next, during the second subframe 2SF of one frame 1F, when the scan signal S1 is applied to the first gate line 511 for the second time, the data signals (D1*a*-D1*c*)~(Dna-Dnc) for driving the EL elements belonging to the second group are provided through the data lines (521*a*-521*c*)-(52*na*-52*nc*) to the corresponding transistors. Here, when the light emitting control signals EC_11, EC_21 of high and low states are respectively applied to the sequential control devices through the light emitting control lines 591*a*, 591*b* from the light emitting control signal generation circuit 590, the thin film transistors for controlling the second group of EL elements among the thin film transistors of the sequential control devices are turned on, so that the driving currents corresponding to the data signals (D1*a*-D1*c*)~(Dna-Dnc) are provided to drive the EL elements of the second group.

When the scan signal is applied to the gate line for each subframe of one frame by repeating the operation illustrated above, the data signals (D1*a*-D1*c*)~(Dna-Dnc) are sequentially applied to the data lines (521*a*-521*c*)~(52*na*-52*nc*). Further, the light emitting control signals (EC_11, EC_21)~(EC_1*m*, EC_2*m*) for sequentially controlling the R, G and B EL elements of two adjacent pixels among pixels (P11-P12*n*)~(Pm1-Pm2*n*) connected to the gate lines 511-51*m* from the light emitting control signal generation circuit 590 through light emitting control lines 591*a*, 591*b* are sequentially generated to the sequential control devices. Therefore, in the first subframe of one frame, the thin film transistors corresponding to the first EL element group among the thin film transistors of the sequential control devices are turned on to drive the EL elements of the first group according to the data signals (D1*a*-D1*c*)~(Dna-Dnc). In addition, in the second subframe, the thin film transistors corresponding to the second EL element group among the thin film transistors of the sequential control devices are turned on to drive the EL elements of the second group according to the data signals (D1*a*-D1*c*)~(Dna-Dnc).

For a method of driving the OLED as illustrated above, one frame is divided into two subframes, and in the first subframe, the EL elements grouped into the first group among the R, G and B EL elements of two adjacent pixels among pixels connected to the first to $m_{th}$ gate lines 511-51*m* are sequentially driven. Further, in the second subframe, the EL elements grouped into the second group are sequentially driven, thereby sequentially driving the EL elements grouped into the first group and the EL elements grouped into the second group and displaying the picture, by each subframe within one frame.

Figure 17:
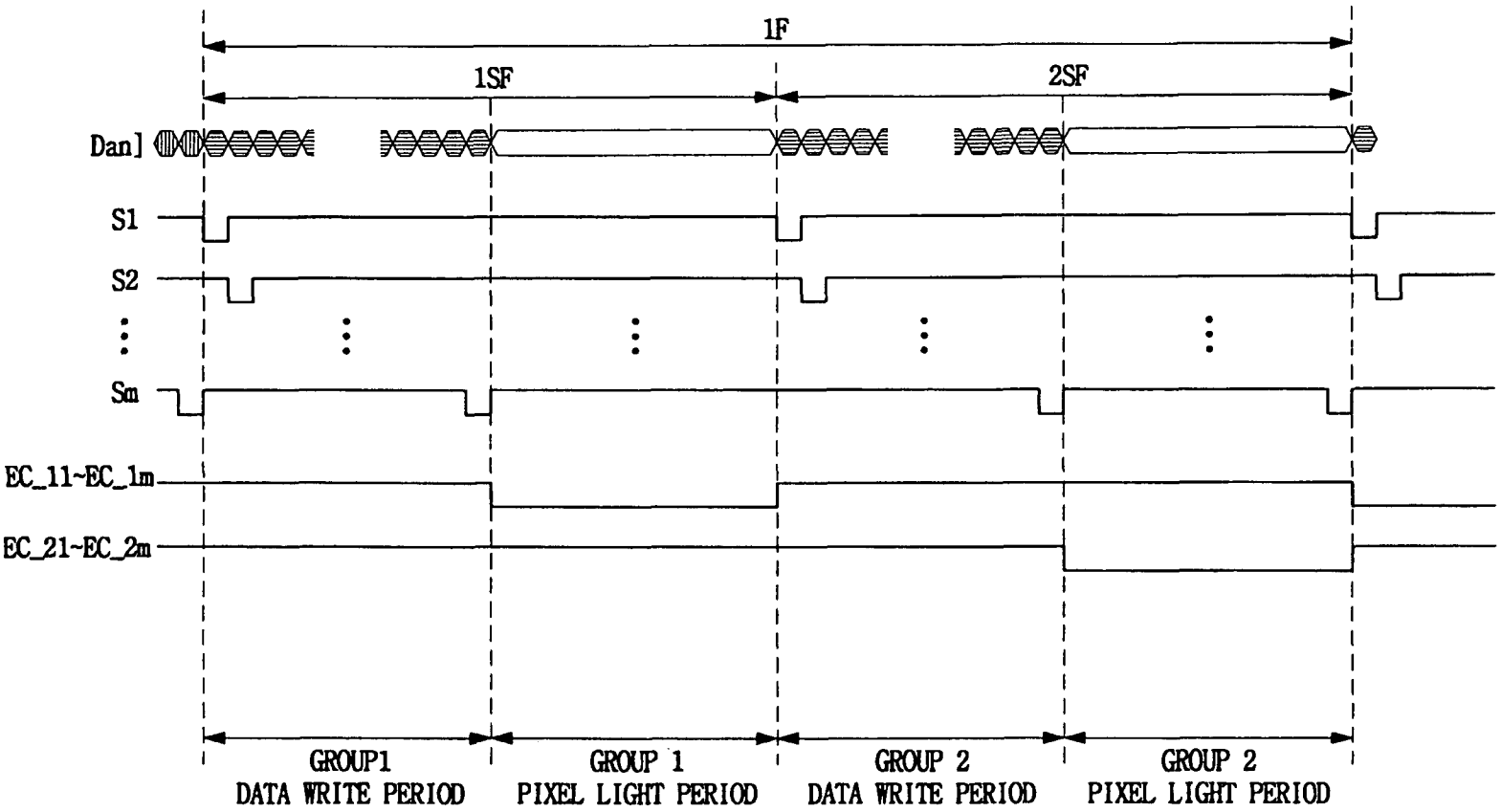
FIG. 17 illustrates an operational waveform diagram where the OLED display of FIG. 4 is driven in a collective light emitting driving method.

FIG. 17 is another operational waveform diagram for illustrating a method of sequentially driving the OLED display of FIG. 4 by time division, which is a collective light emitting method that collectively light emit the EL elements connected to the scan line in each subframe. A method of driving the OLED display by a collective light emitting method will now be described as follows with reference to the operational waveform diagram of FIG. 17.

The collective light emitting method divides one frame 1F into two subframes 1SF, 2SF, and divides again each subframe 1SF, 2SF into a data write period and a pixel light emitting period. During the data write period of the first subframe 1SF, when the scan signals S1-Sm are sequentially applied from the gate line driving circuit 510 to the fist gate line 511 to the $m_{th}$ gate line 51*m*, the data signals (D1*a*-D1*c*)~(Dna-Dnc) for driving the EL elements belonging to the first group among the R, G and B EL elements of the pixels (P11-P12*n*)~(Pm1-Pm2*n*) connected to the first gate line 511 to the $m_{th}$ gate line 51*m* are sequentially provided to each corresponding driving transistor from the data line driving circuit 520.

When the data writing for driving the EL elements belonging to the first group as illustrated above is completed, during the pixel light emitting period of the first subframe, low-state light emitting control signals EC_11-EC1*m* and high-state light emitting control signals EC_21-EC_2*m* are respectively provided at the same time to each of the light emitting control lines (591*a*-59*ma*) and (591*b*-59*mb*) from the light emitting control signal generation circuit 590, so that the thin film transistors for controlling the EL elements belonging to the first group among the thin film transistors of the sequential control devices are substantially simultaneously turned on. Therefore, the driving currents corresponding to the data signals (D1*a*-D1*c*)~(Dna-Dnc) are substantially simultaneously provided to the EL elements of the first group, thereby collectively light emitting the EL elements of the first group.

Next, during data write period of the second subframe 2SF, when the scan signals S1-Sm are sequentially applied from the gate line driving circuit 510, data signals (D1*a*-D1*c*)~(Dna-Dnc) for driving the EL elements belonging to the second group among the R, G and B EL elements of pixels (P11-P12*n*)~(Pm1-Pm2*n*) connected to the first gate line 511 to the $m_{th}$ gate line 51*m* are sequentially provided to each corresponding driving transistor from the data line driving circuit 520.

Therefore, when the data writing for driving the EL elements belonging to the second group is completed, during the pixel light emitting period of the second subframe, high-state light emitting control signals EC_11-EC1*m* and low-state light emitting control signals EC_21-EC_2*m* are substantially simultaneously provided to each of the light emitting control lines (591*a*-59*ma*) and (591*b*-59*mb*) from the light emitting control signal generation circuit 590 respectively, so that the thin film transistors for controlling the EL elements belonging to the second group among the thin film transistors of the sequential control devices are substantially simultaneously turned on. Therefore, the driving currents corresponding to the data signals (D1*a*-D1*c*)~(Dna-Dnc) are substantially simultaneously provided to the EL elements of the second group, thereby collectively light emitting the EL elements of the second group. In this manner, the picture is displayed within one frame.

Figure 5:
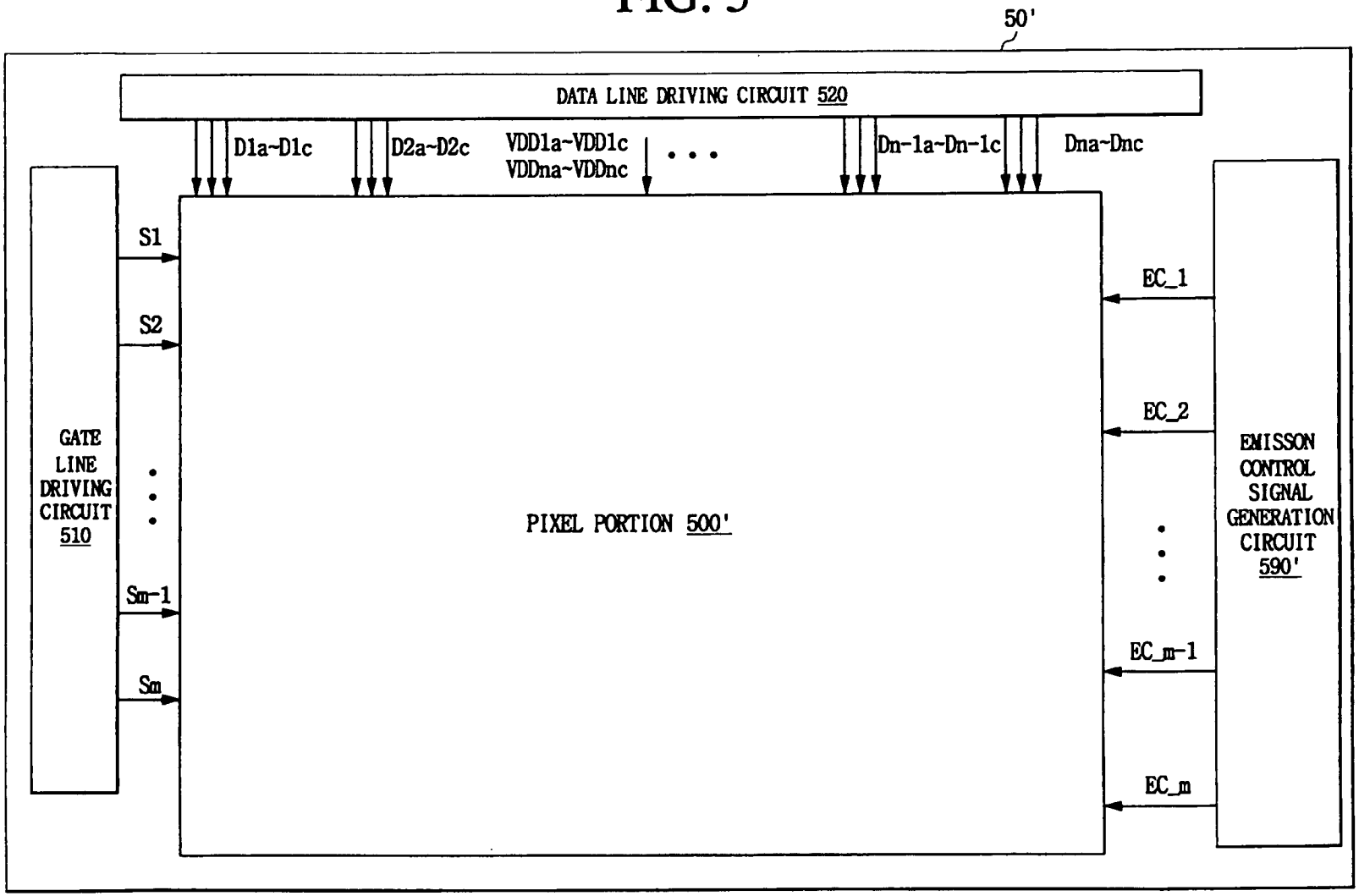
FIG. 5 is a block configuration diagram of an OLED display according to a second exemplary embodiment of the present invention.
Figure 7:
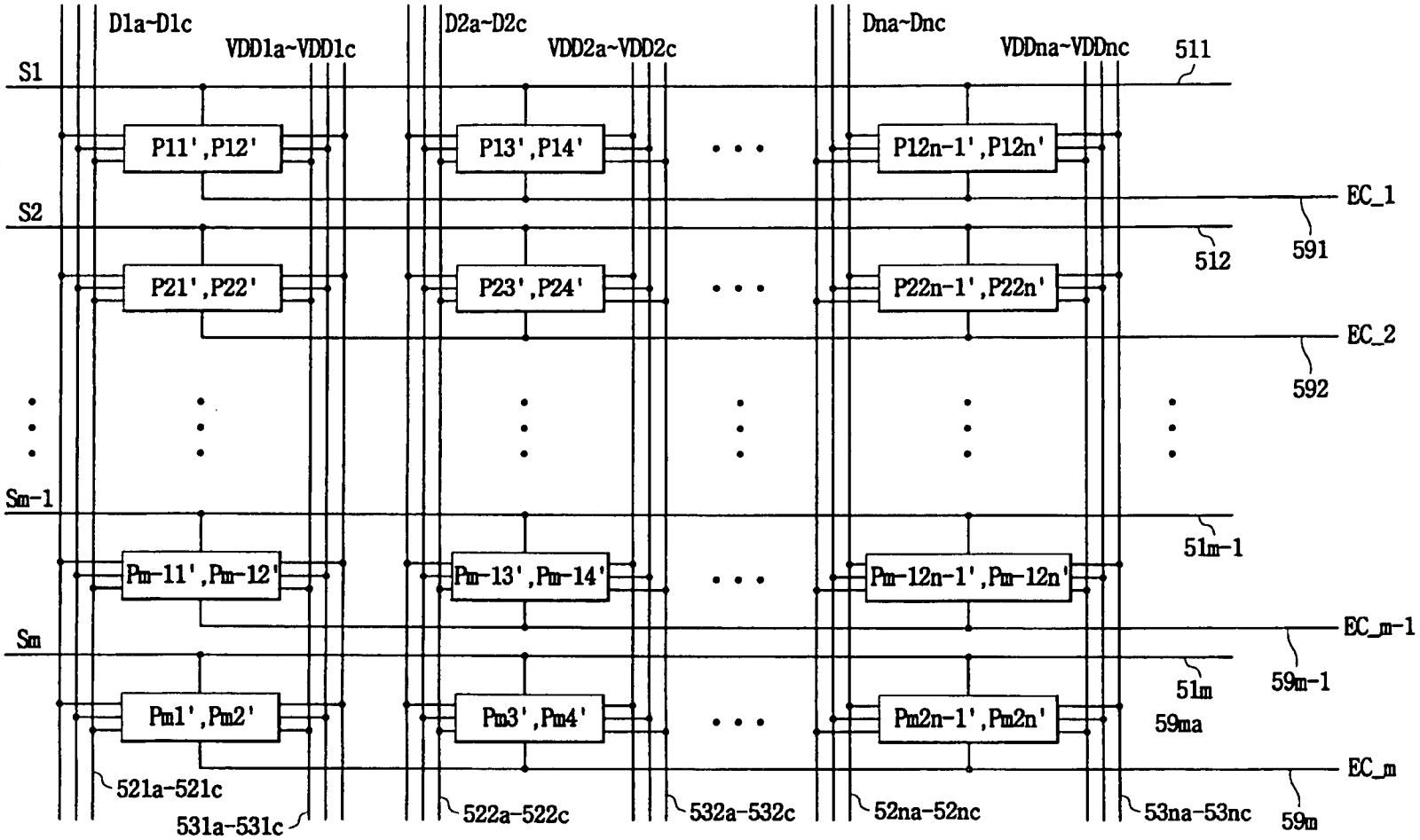
FIG. 7 is a configuration diagram of a pixel portion of the OLED display of FIG. 5.

Referring to FIGS. 5 and 7, an OLED display 50' according to a second exemplary embodiment of the present invention is almost identical to the OLED display 50 of FIGS. 4 and 6. However, in the first exemplary embodiment, the light emitting control signals (EC_11, EC_21)~(EC_1*m*, EC_2*m*) are provided from the light emitting control signal generation circuit 590 through each pair of light emitting control lines (591*a*, 591*b*)-(59*ma*, 59*mb*) to the pixels (P11-P12*n*)~(Pm1-Pm2*n*) arranged in the same scan line. On the other hand, in the second exemplary embodiment, the light emitting control signals EC_1~EC_m are provided from a light emitting control signal generation circuit 590' through one light emitting control line 591-59*m* to pixels (P11'-P12*n*')~(Pm1'-Pm2*n*') arranged in the same scan line.

Figure 9:
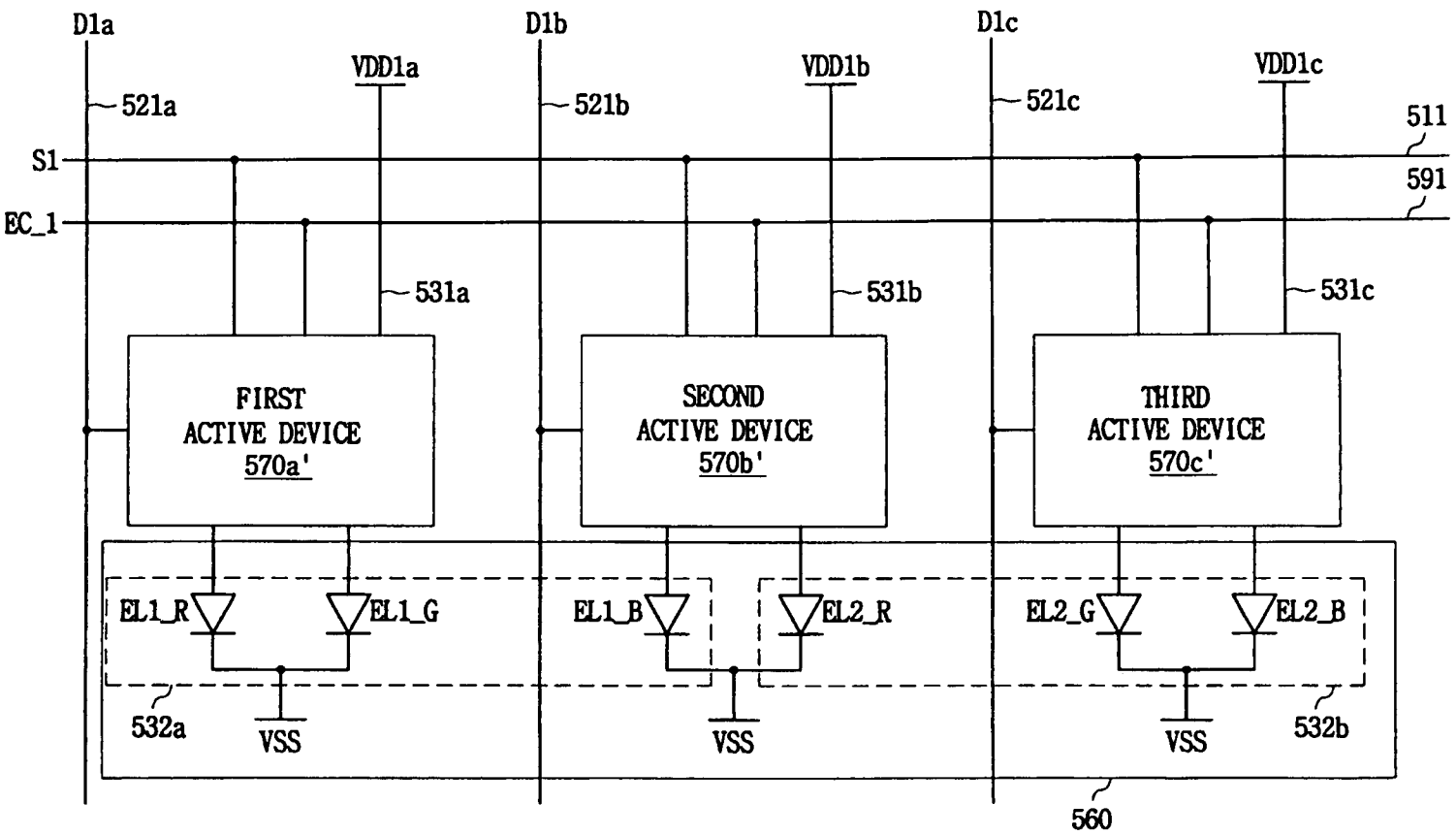
FIG. 9 is a block configuration diagram of a pixel circuit of the OLED display of FIG. 5.
Figure 11:
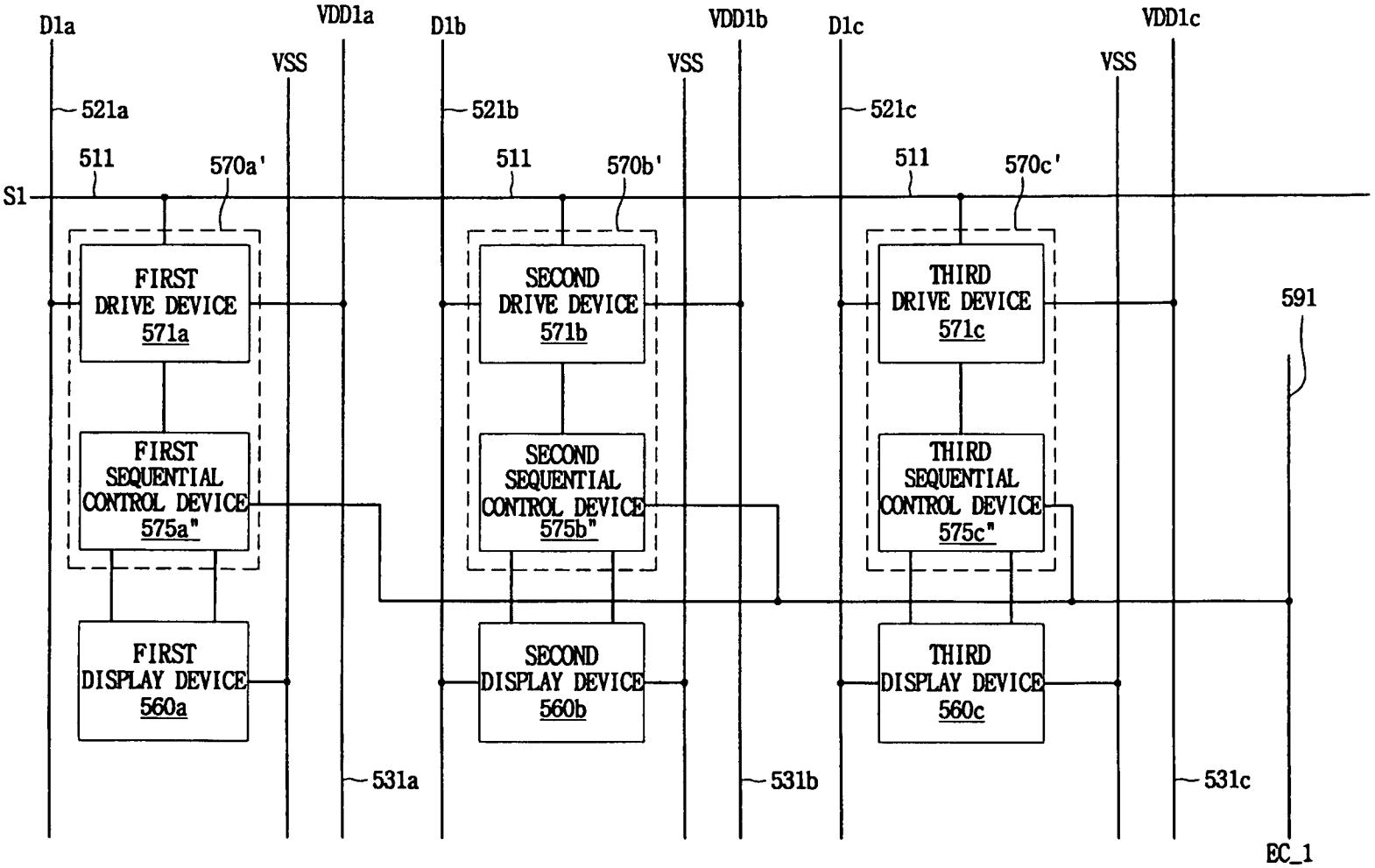
FIG. 11 is a detailed block configuration diagram of the pixel circuit of FIG. 9.
Figure 14:
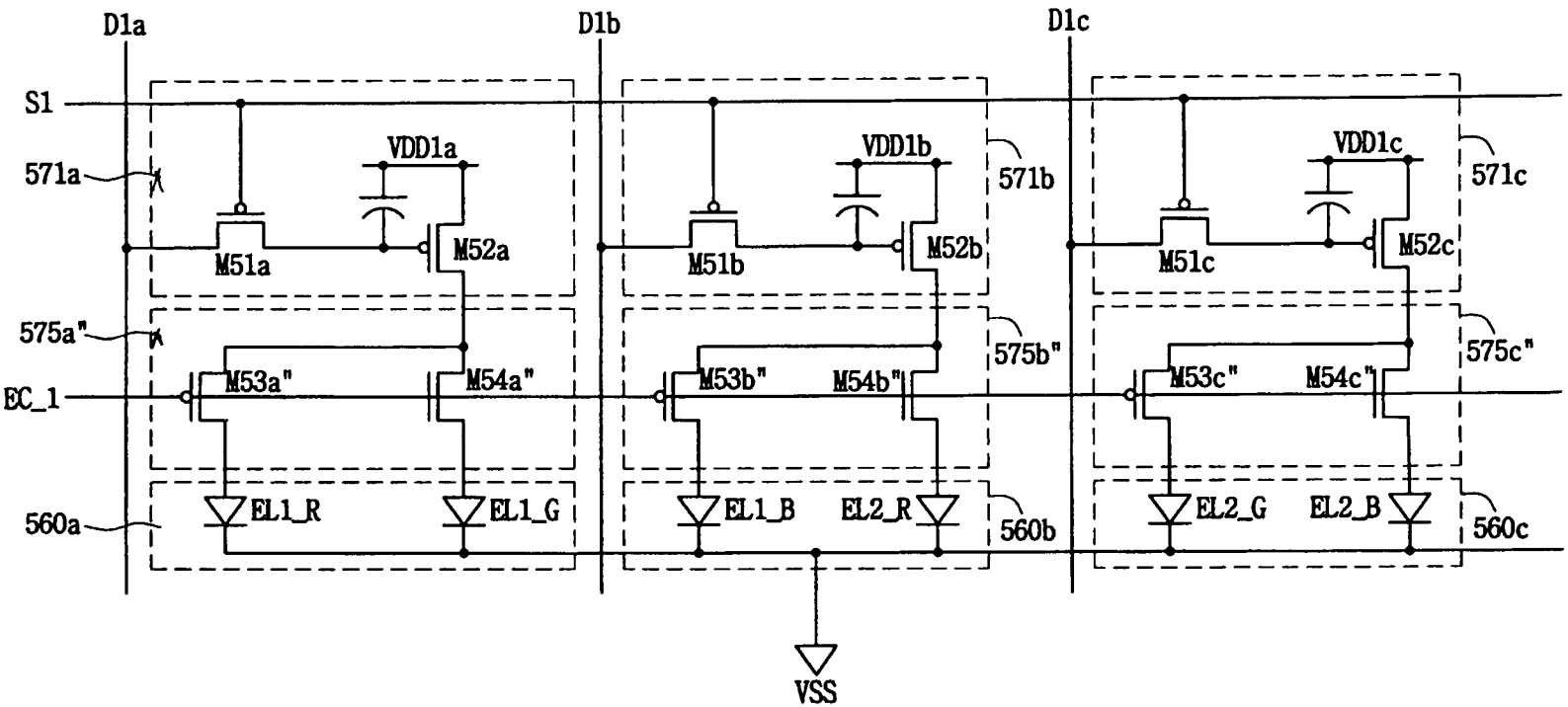
FIG. 14 illustrates a pixel circuit that can be applied as the pixel circuit of FIG. 11.

FIG. 9 is a block configuration diagram that schematically illustrates the pixel circuit of two adjacent pixels, in the OLED display 50' according to the second exemplary embodiment of the present invention shown in FIG. 7, and FIG. 11 illustrates a detailed block configuration diagram of the pixel circuit of FIG. 9. FIG. 14 illustrates an example of the detailed configuration of the pixel circuit shown in FIGS. 9 and 11. Here, in FIGS. 9, 11 and 14, only two adjacent pixels, i.e., the first and second pixels P11', P12' are shown for illustrative purposes.

Referring to FIGS. 9, 11, and 14, two adjacent pixels P11', P12' include a display element 560 having the R, G and B EL elements (EL1_R, EL1_G, EL1_B) 532*a*, (EL2_R, EL2_G, EL2_B) 532*b*, and first to third active elements ("active devices") 570*a*'-570*c*' for driving the R, G and B EL elements (EL1_R, EL1_G, EL1_B) 532*a*, (EL2_R, EL2_G, EL2_B) 532*b*. The first to third active elements 570*a*'-570*c*' respectively include the first to third drive devices 571*a*-571*c* and the sequential control devices 575*a*"-575*c*".

The first to third drive devices 571*a*-571*c* of the first to third active elements 570*a*'-570*c*' have the same configuration as the corresponding elements of the first exemplary embodiment as illustrated in FIG. 12. The grouping method of the display element 560 having the first to third display devices 560*a*-560*c* is also the same as that of the pixel circuit of the first exemplary embodiment as illustrated in FIG. 12.

The first sequential control device 575*a*" of the first active element 570*a*' includes a P-type thin film transistor M53*a*" having a light emitting control signal EC_1 provided through the light emitting control line 591 applied to a gate, a source connected to a drain of the driving transistor M52*a* of the drive device 571*a*, and a drain connected to an anode electrode of the EL element EL1_R of the display device 560*a*. The first sequential control device 575*a*" also includes an N-type thin film transistor M54*a*" having the light emitting control signal EC_1 applied to a gate through the light emitting control line 591, a drain connected to the driving transistor M52*a* of the drive device 571*a*, and a source connected to the anode electrode of the EL element EL1_G of the display device 560*a*.

The second sequential control device 575*b*" of the second active element 570*b*' includes a P-type thin film transistor M53*b*" having the light emitting control signal EC_1 applied to a gate through the light emitting control line 591, a source connected to a drain of the driving transistor M52*b* of the drive device 571*b*, and a drain connected to the anode electrode of the EL element EL1_B of the display device 560*b*. The second sequential control device 575*b*" also includes an N-type thin film transistor M54*b*" having the light emitting control signal EC_1 applied to a gate through the light emitting control line 591, a drain connected to the drain of the driving transistor M52*b* of the drive device 571*b*, and a source connected to the anode electrode of the EL element EL2_R of the display device 560*b*.

The third sequential control device 575*c*" of the third active element 570*c*' includes a P-type thin film transistor M53*c*" having the light emitting control signal EC_1 provided through the light emitting control line 591 applied to a gate, a source connected to the drain of the driving transistor M52*c* of the drive device, and a drain connected to the anode electrode of the EL element EL2_G of the display device 560*c*. The third sequential control device 575*c*" also includes an N-type thin film transistor M54*c*" having the light emitting control signal EC_1 provided through the light emitting control line 591 applied to a gate, a drain connected to the drain of the driving transistor M52*c* of the drive device 571*c*, and a source connected to the anode electrode of the EL element EL2_B of the display device 560*c*.

According to the method of driving the pixel circuit of the OLED display in second exemplary embodiment of the present invention, each of the sequential control devices 575*a*-575*c* includes a P-type thin film transistor and an N-type thin film transistor, and is identical to the method of driving the pixel circuit of the first exemplary embodiment except that the second exemplary embodiment is controlled through only one light emitting control signal per scan line.

Figure 16:
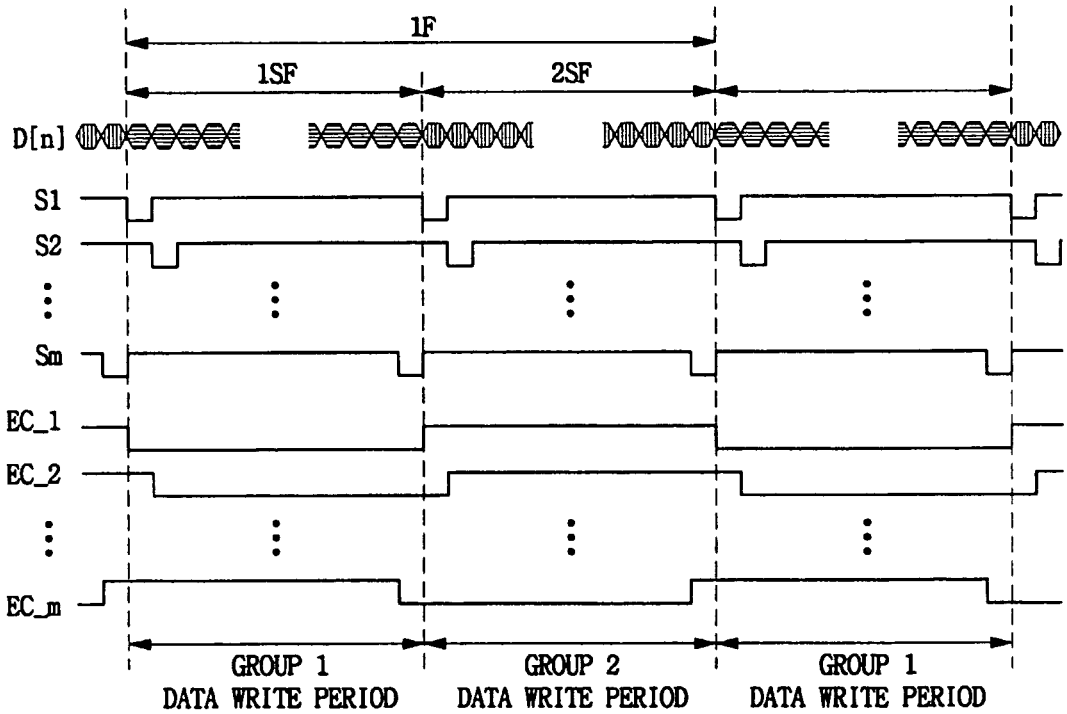
FIG. 16 illustrates an operational waveform diagram where the OLED display of FIG. 5 is driven in a sequential light emitting driving method.

FIG. 16 is an operational waveform diagram for illustrating a method of time-divisionally driving the OLED display of FIG. 5, which is a sequential light emitting method that sequentially light emit the EL elements by scan line within each subframe. A method of driving the OLED display by sequential light emitting method will now be described as follows with reference to the operational waveform diagram of FIG. 16.

First, during the first subframe 1SF of one frame 1F, when the scan signal S1 is applied form the gate line driving circuit 510 to the first gate line 511, the first gate line 511 is driven, and the data signals, as (D1*a*-D1*c*)~(Dna-Dnc), for driving the EL elements belonging to the first group among the R, G and B EL elements of the pixels P11'-P2*n*' connected to the first gate line 511 from the data line driving circuit 520 are provided to the corresponding driving transistors.

Here, when the low-state light emitting control signal EC_1 through the light emitting control line 591 from the light emitting control signal generation circuit 590' is generated, only the p-type thin film transistors for controlling the EL elements belonging to the first group among the thin film transistors constituting the sequential control device are turned on, so that the driving currents corresponding to the data signals (D1*a*-D1*c*)~(Dna-Dnc) are provided to drive the EL elements of the first group.

Next, during the second subframe 2SF of one frame 1F, when the scan signal S1 is applied to the first gate line 511 for the second time, the data signals (D1*a*-D1*c*)~(Dna-Dnc) for driving the EL elements belonging to the second group are provided to the data lines (521*a*-521*c*)~(52*na*-52*nc*), so that the driving transistors corresponding to the EL elements belonging to the second group are driven. Here, when the high-state light emitting control signal EC_1 through the light emitting control line 591 from the light emitting control signal generation circuit 590' is applied to the sequential control device, n-type thin film transistors for controlling the EL elements belonging to the second group among the thin film transistors of the sequential control devices are turned on, and the driving currents corresponding to the data signals (D1*a*-D1*c*)~(Dna-Dnc) are provided to drive the EL elements of the second group.

When the scan signals are applied to the gate lines 511-51*m* by each subframe of one frame by repeating the operation as illustrated above, the data signals (521*a*-521*c*)~(52*na*-52*nc*) are sequentially applied to the data lines (521*a*-521*c*)~(52*na*-52*nc*), and the light emitting control signals EC_1-EC_m for sequentially controlling the R, G and B EL elements of two adjacent pixels among pixels (P11'-P12*n*')~(Pm1'-Pm2*n*') connected to the gate line (511-51*m*) through the light emitting control line 591 from the light emitting control signal generation circuit 590' are sequentially applied to the sequential control devices. Accordingly, the p-type thin film transistors corresponding to the first group of EL elements among the thin film transistors of the sequential control devices are turned on, and based on the data signals (D1*a*-D1*c*)~(Dna-Dnc), the EL elements of the first group are driven. In the next subframe, the n-type thin film transistors corresponding to the second group of EL elements among the thin film transistors of the sequential control devices are turned on, so that based on the data signals (D1*a*-D1*c*)~(Dna-Dnc), the EL elements of the second group are driven.

Figure 18:
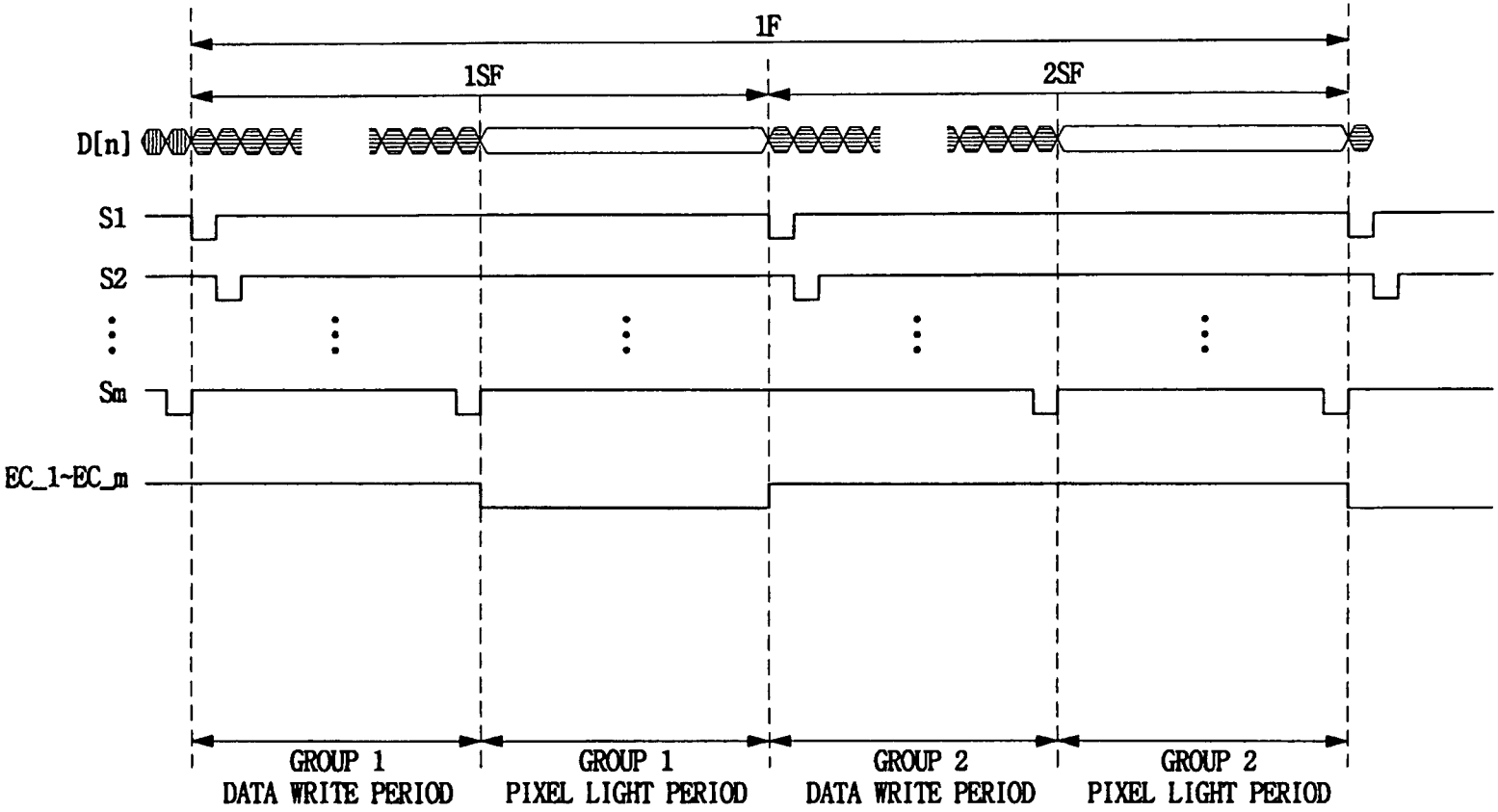
FIG. 18 illustrates an operational waveform diagram where the OLED display of FIG. 5 is driven in a collective light emitting driving method.

FIG. 18 is another operational waveform diagram for illustrating a method of time-divisionally driving the OLED display of FIG. 5, which is a collective light emitting method that collectively light emit the EL elements connected to the scan line within each subframe. A method of driving the OLED display by the collective light emitting method will now be described as follows with reference to the operational waveform of FIG. 18.

During the data write period of the first subframe 1SF, when the scan signals S1-Sm are sequentially applied from the gate line driving circuit 510 to the first gate line 511 to the $m_{th}$ gate line 51*m*, the data signals (D1*a*-D1*c*)~(Dna-Dnc) for driving the EL elements belonging to the first group among the R, G and B EL elements of the pixels (P11'-P12*n*')~(Pm1'-Pm2*n*') connected to the first gate line 511 to the $m_{th}$ gate line 51*m* are provided to the corresponding driving transistors from the data line driving circuit 520.

When the data writing for driving the EL elements belonging to the first group is completed as described above, during the pixel light emitting period of the first subframe, low-state light emitting control signals EC_1-EC_m from the light emitting control signal generation circuit 590' are substantially simultaneously provided to the light emitting control lines 591-59*m*, so that the thin film transistors for controlling the EL elements belonging to the first group among the thin film transistors of the sequential control devices are substantially simultaneously turned on. Therefore, the driving currents corresponding to the data signals (D1*a*-D1*c*)~(Dna-Dnc) are substantially simultaneously provided to the EL elements of the first group, so that the EL elements of the first group collectively emit light at substantially the same time.

Next, during data write period of the second subframe 2SF, when the scan signals S1-Sm are sequentially applied from the gate line driving circuit 510 to the first gate line 511 through the $m_{th}$ gate line 51*m*, data signals (D1*a*-D1*c*)~(Dna-Dnc) for driving the EL elements belonging to the second group among the R, G and B EL elements of the pixels (P11'-P12*n*')~(Pm1'-Pm2*n*') connected to the first gate line 511 through the $m_{th}$ gate line 51*m* are sequentially provided from the data line driving circuit 520 to the corresponding driving transistors.

Therefore, when the data writing for driving the EL elements belonging to the second group is completed, during the pixel light emitting period of the second subframe, high-state light emitting control signals EC_1-EC_m are substantially simultaneously provided from the light emitting control signal generation circuit 590' to each of the light emitting control lines 591-59*m*, so that thin film transistors for controlling the EL elements belonging to the second group among the thin film transistors of the sequential control devices are substantially simultaneously turned on. Therefore, the driving currents corresponding to the data signals (D1*a*-D1*c*)~(Dna-Dnc) are substantially simultaneously provided to the second group of EL elements, so that the EL elements of the second group collectively emit light at substantially the same time. In this manner, the picture is displayed in one frame.

As illustrated above, the method of driving the OLED display according to the first and second exemplary embodiments of the present invention divides one frame into two subframes, and in the first subframe, sequentially or collectively drives the EL elements grouped into the first group among the R, G and B EL elements of two adjacent pixels among the pixels connected to the first to the $m_{th}$ gate line (511-51*m*). Further, in the second subframe, the method sequentially or collectively drives the EL elements grouped into the second group. This way, the EL elements grouped into the first group and the EL elements grouped into the second group are time-divisionally driven, and the picture is displayed by each subframe within one frame.

According to the exemplary embodiments of the present invention, R, G and B EL elements of two adjacent pixels are classified into two groups and are time-divisionally driven by each subframe where grouping the EL elements belonging to the first group and the EL elements belonging to the second group are arbitrarily changeable, and the driving sequence of the first and second EL groups is also changeable. In other embodiments, one or more pixels of the OLED display may also include white (W) EL elements instead of or in addition to one of more of R, G and B EL elements. In addition, the El elements may be arranged in a stripe type or a delta type.

Further, according to the OLED display of the present invention, white balance can be adjusted by adjusting the light emitting time of the R, G and B EL elements. A turn-on time of the thin film transistor of the sequential control device, that is, the duty ratio of the light emitting control signal, can be adjusted to adjust the light emitting time of the R, G and B EL elements, thereby adjusting the white balance.

According to the first and second exemplary embodiments of the present invention, each of the first to third drive devices (571*a*, 571*b*, 571*c*) includes two thin film transistors, that is, the switching transistor and the driving transistor, and one capacitor. In other embodiments, any configuration capable of driving the light emitting elements constituting the display device 560 may be used for the drive devices, and all methods capable of enhancing the driving characteristics of the light emitting element of the display device 560 may be used. By way of example, a threshold voltage compensation device and/or other suitable devices may be added. Further, while all of the thin film transistors used in the first to third drive devices 571*a*-571*c* are P-type thin film transistors, one or more N-type thin film transistors and/or a combination of N-type thin film transistors and P-type thin film transistors may be used instead. Further, the N-type or P-type thin film transistor may be configured to operate in a depletion mode or in an enhancement mode. In addition, instead of configuring the drive devices 571*a*-571*c* with thin film transistors, a various types of switching devices, such as a thin film diode (TFD), a diode, and/or TRS (triodic rectifier switch), etc., may also be used.

While the first to third sequential control devices 575*a*, 575*b*, 575*c* or 575*a*", 575*b*", 575*c*" are configured only with P-type thin film transistors or a combination of the N-type and P-type thin film transistors in the described exemplary embodiments, the sequential control devices may also be configured with any other suitable combination of different types of transistors. Further, the N-type thin film transistors or the P-type thin film transistors may be configured to operate in the depletion mode or in the enhancement mode. In addition, instead of configuring the sequential control devices 575*a*, 575*b*, 575*c* with thin film transistors, various different types of switching devices, such as a TFD, a diode, a TRS (triodic rectifier switch), etc. may also be used. Further, any suitable configuration may be used for the sequential control devices to sequentially drive the R, G and B EL elements.

According to the exemplary embodiments of the present invention, while R, G and B EL elements driven with one active element are described as an example, the method of driving the R, G and B EL elements with one active element as illustrated in the exemplary embodiments of the present invention may also be applied to other light emitting element based display devices, such as a field emission display (FED), and the like. Hence, the light emitting elements may be Field Emission Diodes.

The OLED display according to the exemplary embodiments of the present invention as illustrated above shares two EL elements driving thin film transistors and the switching thin film transistors among two adjacent R, G and B EL elements, thus driven by time division, thereby enabling high definition, reducing the number of the devices and lines, and enhancing the aperture ratio and yield.

While certain exemplary embodiments of the present invention have been described above, those skilled in the art would recognize that a variety of modification and change can be made without departing from the spirit or scope of the present invention described in the claims appended below, and equivalents thereof.

What is claimed is:

1. A display device for displaying a predetermined color during an interval, comprising:

a plurality of pixels arranged in rows, each said pixel having at least three light emitting elements, each said light emitting element for emitting a corresponding color in the interval, each of the light emitting elements comprising a first electrode and a second electrode and being a part of only one of the pixels, each said light emitting element being a member of either a first light emitting element group or a second light emitting element group, and each pixel including at least one light emitting element from each of the first light emitting element group and the second light emitting element group;

a plurality of scan lines, wherein each row has a corresponding scan line and all of the pixels in a same row correspond to a same scan line; and a plurality of active elements for driving the light emitting elements, each of the active elements being coupled to the first electrodes of corresponding ones of the light emitting elements, wherein all of the second electrodes of the light emitting elements in at least two of the pixels are directly connected together, wherein a first active element of the active elements is configured to time-divisionally drive a first light emitting element and a second light emitting element from a first pixel among the plurality of pixels, and a second active element of the active elements is configured to time-divisionally drive a third light emitting element from the first pixel and a first light emitting element from a second pixel among the plurality of pixels, the first pixel adjacent to the second pixel, the third light emitting element from the first pixel or the first light emitting element from the second pixel being driven in a given period within the interval, thereby displaying the predetermined color during the interval, wherein the second active element comprises a drive device and a sequential control device, the sequential control device being configured to selectively couple the drive device to the third light emitting element from the first pixel or the first light emitting element from the second pixel, and wherein the rows of pixels are configured to be first scanned sequentially for only the first light emitting element group and then afterwards scanned sequentially for the second light emitting element group.

2. The display device of claim 1, wherein the interval is one frame, the given period is a subframe, and the one frame is divided into two subframes, and wherein the third light emitting element from the first pixel and the first light emitting element from the second pixel are time-divisionally driven within the one frame, one of the third light emitting element from the first pixel or the first light emitting element from the second pixel being driven in a first one of the subframes and the other one of the third light emitting element from the first pixel or the first light emitting element from the second pixel being driven in a second one of the subframes.

3. The display device of claim 2, wherein at least two said light emitting elements that emit different said corresponding colors are substantially simultaneously emitted within one said subframe, so that at least two different said corresponding colors are emitted within the one said subframe.

4. The display device of claim 1, wherein a light emitting time of the third light emitting element from the first pixel and the first light emitting element from the second pixel is adjusted to control white balance of the predetermined color.

5. The display device of claim 1, wherein each said light emitting element is a Field Emission Diode.

6. The display device of claim 1, wherein the light emitting elements are selected from red, green, blue, and white electroluminescent elements.

7. The display device of claim 6, wherein for each of the third light emitting element from the first pixel and the first light emitting element from the second pixel, a first electrode is connected to the second active element and a second electrode is connected to a ground voltage.

8. The display device of claim 6, wherein the electroluminescent elements are arranged in a stripe type—or a delta type.

9. The display device of claim 1, wherein the second active element includes at least one switching element for driving the third light emitting element from the first pixel and the first light emitting element from the second pixel.

10. The display device of claim 9, wherein said at least one switching element includes a thin film transistor, a thin film diode, a diode or a TRS (triodic rectifier switch).

11. A display device, comprising:

a plurality of pixels arranged in rows, each said pixel having at least three electroluminescent elements, each said electroluminescent element for emitting a corresponding one of colors within an interval, each of the electroluminescent elements comprising a first electrode and a second electrode and being a part of only one of the pixels, each said electroluminescent element being a member of either a first electroluminescent element group or a second electroluminescent element group, and each pixel including at least one electroluminescent element from each of the first electroluminescent element group and the second electroluminescent element group;

a plurality of scan lines, wherein each row has a corresponding scan line and all of the pixels in a same row correspond to a same scan line; and a plurality of active elements for driving the electroluminescent elements, each of the active elements being coupled to the first electrodes of corresponding ones of the electroluminescent elements, wherein all of the second electrodes of the electroluminescent elements in at least two of the pixels are directly connected together, and wherein a first active element of the active elements is configured to time-divisionally drive a first electroluminescent element and a second electroluminescent element from a first pixel among the plurality of pixels, and a second active element of the active elements is configured to time-divisionally drive a third electroluminescent element from the first pixel and a first electroluminescent element from a second pixel among the plurality of pixels, the first pixel adjacent to the second pixel, the third electroluminescent element from the first pixel or the first electroluminescent element from the second pixel being driven in a given period within the interval, wherein the second active element comprises a drive device and a sequential control device, the sequential control device being configured to selectively couple the drive device to the third electroluminescent element from the first pixel or the first electroluminescent element from the second pixel, wherein at least two said electroluminescent elements that emit different said colors are substantially simultaneously driven within the given period to emit at least two different said colors, and wherein the rows of pixels are configured to be first scanned sequentially for only the first electroluminescent element group and then afterwards scanned sequentially for the second electroluminescent element group.

12. The display device of claim 11, wherein the second active element comprises:

a drive device commonly connected to the third electroluminescent element from the first pixel and the first electroluminescent element from the second pixel for driving the third electroluminescent element from the first pixel and the first electroluminescent element from the second pixel; and a sequential control device configured to time-divisionally control the third electroluminescent element from the first pixel and the first electroluminescent element from the second pixel based on a light emitting control signal.

13. The display device of claim 12, wherein the drive device comprises:

at least one switching transistor for switching data signals;

a capacitor for storing the data signals; and at least one driving transistor configured to provide driving currents corresponding to the data signals to the third electroluminescent element from the first pixel and the first electroluminescent element from the second pixel.

14. The display device of claim 13, wherein the drive device further comprises:

a threshold voltage compensation device configured to compensate a threshold voltage of said at least one driving transistor.

15. The display device of claim 12, wherein the sequential control device comprises:

a first thin film transistor having a first light emitting control signal provided to a gate, a source connected to the drive device, and a drain connected to an anode electrode of one of the third electroluminescent element from the first pixel or the first electroluminescent element from the second pixel; and a second thin film transistor having a second light emitting control signal provided to a gate, a source connected to the drive device, and a drain connected to an anode electrode of the other one of the third electroluminescent element from the first pixel or the first electroluminescent element from the second pixel.

16. The display device of claim 12, wherein the sequential control device comprises:

a first thin film transistor having a light emitting control signal provided to a gate, a source connected to the drive device, and a drain connected to an anode electrode of one of the third electroluminescent element from the first pixel or the first electroluminescent element from the second pixel; and a second thin film transistor having the light emitting control signal provided to a gate, a drain connected to the drive device, and a source connected to an anode electrode of the other one of the third electroluminescent element from the first pixel or the first electroluminescent element from the second pixel.

17. The display device of claim 11, wherein the electroluminescent elements are arranged in a stripe type or a delta type.

18. An organic light emitting display device comprising:

a plurality of pixels arranged in rows, each said pixel having at least three electroluminescent elements, each said electroluminescent element for emitting a corresponding color within an interval, each of the electroluminescent elements comprising a first electrode and a second electrode and being a part of only one of the pixels, each said light emitting element being a member of either a first light emitting element group or a second light emitting element group, and each pixel including at least one light emitting element from each of the first light emitting element group and the second light emitting element group;

a plurality of scan lines, wherein each row has a corresponding scan line and all of the pixels in a same row correspond to a same scan line; and a plurality of active elements for driving the electroluminescent elements, each of the active elements being coupled to the first electrodes of corresponding ones of the electroluminescent elements, wherein all of the second electrodes of the electroluminescent elements in at least two of the pixels are directly connected together, wherein a first active element of the active elements is configured to time-divisionally drive a first electroluminescent element and a second electroluminescent element from a first pixel among the plurality of pixels, and a second active element of the active elements is configured to time-divisionally drive a third electroluminescent element from the first pixel and a first electroluminescent element from a second pixel among the plurality of pixels, the first pixel adjacent to the second pixel, the third electroluminescent element from the first pixel or the first electroluminescent element from the second pixel being driven in a given period within the interval, wherein the second active element comprises:

a first thin film transistor having a gate connected to a corresponding one of the plurality of scan lines and one of a source and a drain connected to a data line;

a second thin film transistor having a gate connected to the other one of the source and the drain of the first thin film transistor and one of a source and a drain connected to a power supply line;

a capacitor connected between the gate and said one of the source and the drain of the second thin film transistor;

a third thin film transistor having one of a source and a drain connected to the other one of the source and the drain of the second thin film transistor, a first light emitting control signal applied to a gate, and the other one of the source and the drain connected to an anode electrode of one of the third electroluminescent element from the first pixel or the first electroluminescent element from the second pixel; and a fourth thin film transistor having one of a source and a drain connected to the other one of the source and the drain of the second thin film transistor, a second light emitting control signal applied to a gate, and the other one of the source and the drain connected to an anode electrode of the other one of the third electroluminescent element from the first pixel or the first electroluminescent element from the second pixel, wherein the second active element is configured to control the third thin film transistor and the fourth thin film transistor to connect the drain of the second thin film transistor to exactly one of the third electroluminescent element from the first pixel and the first electroluminescent element from the second pixel, and wherein the rows of pixels are configured to be first scanned sequentially for only the first light emitting element group and then afterwards scanned sequentially for the second light emitting element group.

19. An organic light emitting display device comprising:

a plurality of pixels arranged in rows, each said pixel having at least three electroluminescent elements, each said electroluminescent element for emitting a corresponding color within an interval, each of the electroluminescent elements comprising a first electrode and a second electrode and being a part of only one of the pixels, each said light emitting element being a member of either a first light emitting element group or a second light emitting element group, and each pixel including at least one light emitting element from each of the first light emitting element group and the second light emitting element group;

a plurality of scan lines, wherein each row has a corresponding scan line and all of the pixels in a same row correspond to a same scan line; and a plurality of active elements for driving the electroluminescent elements, each of the active elements being coupled to the first electrodes of corresponding ones of the electroluminescent elements, wherein all of the second electrodes of the electroluminescent elements in at least two of the pixels are directly connected together, wherein a first active element of the active elements is configured to time-divisionally drive a first electroluminescent element and a second electroluminescent element from a first pixel among the plurality of pixels, and a second active element of the active elements is configured to time-divisionally drive a third electroluminescent element from the first pixel and a first electroluminescent element from a second pixel among the plurality of pixels, the first pixel adjacent to the second pixel, the third electroluminescent element from the first pixel or the first electroluminescent element from the second pixel being driven in a given period within the interval, wherein the second active element comprises:

a first thin film transistor having a gate connected to a corresponding one of the plurality of scan lines, and one of a source and a drain connected to a data line;

a second thin film transistor having a gate connected to the other one of the source and the drain of the first thin film transistor and one of a source and a drain connected to a power supply line;

a capacitor connected between the gate and said one of the source and the drain of the second thin film transistor;

a third thin film transistor having one of a source and a drain connected to the other one of the source and the drain of the second thin film transistor, a light emitting control signal applied to a gate, and the other one of the source and the drain connected to an anode electrode of one of the third electroluminescent element from the first pixel or the first electroluminescent element from the second pixel; and a fourth thin film transistor having one of a source and a drain connected to the other one of the source and the drain of the second thin film transistor, the light emitting control signal applied to a gate, and the other one of the source and the drain connected to an anode electrode of the other one of the third electroluminescent element from the first pixel or the first electroluminescent element from the second pixel, wherein the second active element is configured to control the third thin film transistor and the fourth thin film transistor to connect the drain of the second thin film transistor to exactly one of the third electroluminescent element from the first pixel and the first electroluminescent element from the second pixel, and wherein the rows of pixels are configured to be first scanned sequentially for only the first light emitting element group and then afterwards scanned sequentially for the second light emitting element group.

20. A display device for displaying a predetermined color during an interval, comprising:

a plurality of pixels arranged in rows, each said pixel having at least three light emitting elements, each said light emitting element for emitting a corresponding color in the interval, each of the light emitting elements comprising a first electrode and a second electrode and being a part of only one of the pixels, all of the second electrodes of the light emitting elements in at least two of the pixels being directly connected together;

a plurality of scan lines, wherein each row has a corresponding scan line and all of the pixels in a same row correspond to a same scan line;

a plurality of drive devices; and a plurality of sequential control devices coupled corresponding ones of the drive devices and corresponding ones of the light emitting elements, wherein at least one of the light emitting elements of a first pixel among the plurality of pixels and at least one of the light emitting elements of a second pixel among the plurality of pixels, adjacent to the first pixel, are grouped into at least a portion of a first light emitting element group, and remaining said light emitting elements of the first and second adjacent said pixels are grouped into at least a portion of a second light emitting element group, wherein the first light emitting element group and the second light emitting element group are time-divisionally driven within the interval, thereby displaying the predetermined color during the interval, wherein the interval is one frame and the one frame is divided into two subframes, wherein the first light emitting element group is driven in one of the two subframes and the second light emitting element group is driven in the other one of the two subframes, wherein each of the sequential control devices is configured to supply a current from the corresponding one of the drive devices, selectively, to a light emitting element of the first light emitting element group or a light emitting element of the second light emitting element group, and wherein the rows of pixels are configured to be first scanned sequentially for only the first light emitting element group and then afterwards scanned sequentially for the second light emitting element group.

21. The display device of claim 20, wherein white balance of the predetermined color is made by adjusting a light emitting time of the light emitting elements in the first light emitting element group and the second light emitting element group.

22. The display device of claim 20, wherein a part from among a plurality of light emitting elements from the first and second adjacent said pixels includes the first light emitting element group and the rest includes the second light emitting element group.

23. A display device for displaying a predetermined color during an interval, comprising:

a plurality of pixels arranged in rows, each said pixel having at least three light emitting elements, each said light emitting element for emitting a corresponding color within the interval, each of the light emitting elements comprising a first electrode and a second electrode and being a part of only one of the pixels, all of the second electrodes of the light emitting elements in at least two of the pixels being directly connected together;

a plurality of scan lines, wherein each row has a corresponding scan line and all of the pixels in a same row correspond to a same scan line;

a plurality of drive devices; and a plurality of sequential control devices coupled corresponding ones of the drive devices and corresponding ones of the light emitting elements, wherein at least one of the light emitting elements from a first pixel and at least one of the light emitting elements from a second pixel, adjacent to the first pixel, are grouped into at least a portion of a first light emitting element group, and remaining said light emitting elements of the first and second adjacent said pixels are grouped into at least a portion of a second light emitting element group, wherein the light emitting elements of the first light emitting element group or the second light emitting element group are driven during a given period within the interval, thereby displaying the predetermined color during the interval, wherein the interval is one frame and the given period is a subframe, and wherein one frame is divided into two subframes, and the first light emitting element group is driven in one of the two subframes and the second light emitting element group is driven in the other one of the two subframes, wherein each of the sequential control devices is configured to supply a current from the corresponding one of the drive devices, selectively, to a light emitting element of the first light emitting element group or a light emitting element of the second light emitting element group, and wherein the rows of pixels are configured to be first scanned sequentially for only the first light emitting element group and then afterwards scanned sequentially for the second light emitting element group.

24. The display device of claim 23, wherein in each of the two subframes, white balance of the predetermined color is made by adjusting a light emitting time of the light emitting elements in the first light emitting element group or the second light emitting element group.

25. The display device of claim 23, wherein the light emitting elements of at least one of the first light emitting element group and the second light emitting element group sequentially or collectively emit light during the given period.

26. The display device of claim 23, wherein a part from among a plurality of light emitting elements from the first and second adjacent said pixels includes the first light emitting element group, and the rest includes the second light emitting element group.

27. An organic light emitting display device comprising:

a plurality of gate lines, a plurality of data lines, a plurality of light emitting control lines and a plurality of power supply lines; and a plurality of pixels arranged in rows, each said pixel being connected to a corresponding said gate line, a corresponding said data line, at least one corresponding said light emitting control line, and a corresponding said power supply line, and having at least three electroluminescent elements, each said electroluminescent element for emitting a corresponding color within an interval, each of the electroluminescent elements comprising a first electrode and a second electrode and being a part of only one of the pixels, each said light emitting element being a member of either a first light emitting element group or a second light emitting element group, and each pixel including at least one light emitting element from each of the first light emitting element group and the second light emitting element group, wherein each row has a corresponding gate line and all of the pixels in a same row correspond to a same gate line; and a plurality of active elements for driving the electroluminescent elements, each of the active elements being coupled to the first electrodes of corresponding ones of the electroluminescent elements, wherein all of the second electrodes of the electroluminescent elements in at least two of the pixels are directly connected together, wherein a first active element of the active elements is configured to time-divisionally drive a first electroluminescent element and a second electroluminescent element from a first pixel among the plurality of pixels, and a second active element of the active elements is configured to time-divisionally drive a third electroluminescent element from the first pixel and a first electroluminescent element from a second pixel among the plurality of pixels, adjacent to the first pixel, the third electroluminescent element from the first pixel or the first electroluminescent element from the second pixel being driven in a given period within the interval, wherein the second active element comprises:

at least one switching transistor for switching data signals supplied from the corresponding said data line in response to a scan signal applied from the corresponding said gate line;

at least one driving transistor for driving the third electroluminescent element from the first pixel and the first electroluminescent element from the second pixel using the data signals provided through said at least one switching transistor;

at least one thin film transistor for time-divisionally controlling the third electroluminescent element from the first pixel and the first electroluminescent element from the second pixel, one of the third electroluminescent element from the first pixel or the first electroluminescent element from the second pixel being driven in the given period, in response to at least one light emitting control signal from said at least one corresponding said light emitting control line;

a drive device; and a sequential control device, the sequential control device being configured to selectively couple the drive device to the third electroluminescent element from the first pixel or the first electroluminescent element from the second pixel, and wherein the rows of pixels are configured to be first scanned sequentially for only the first light emitting element group and then afterwards scanned sequentially for the second light emitting element group.

28. An organic light emitting display device comprising:

a plurality of gate lines, a plurality of data lines, a plurality of light emitting control lines and a plurality of power supply lines; and a plurality of pixels arranged in rows, each said pixel being connected to a corresponding said gate line, a corresponding said data line, at least one corresponding said light emitting control line and a corresponding said power supply line, and having at least three electroluminescent elements, each said electroluminescent element for emitting a corresponding color within an interval, each of the electroluminescent elements comprising a first electrode and a second electrode and being a part of only one of the pixels, each said light emitting element being a member of either a first light emitting element group or a second light emitting element group, and each pixel including at least one light emitting element from each of the first light emitting element group and the second light emitting element group, wherein each row has a corresponding gate line and all of the pixels in a same row correspond to a same gate line; and a plurality of active elements for driving the electroluminescent elements, each of the active elements being coupled to the first electrodes of corresponding ones of the electroluminescent elements, wherein all of the second electrodes of the electroluminescent elements in at least two of the pixels are directly connected together, wherein a first active element of the active elements is configured to time-divisionally drive a first electroluminescent element and a second electroluminescent element from a first pixel among the plurality of pixels, and a second active element of the active elements is configured to time-divisionally drive a third electroluminescent element from the first pixel and a first electroluminescent element from a second pixel among the plurality of pixels, adjacent to the first pixel, the third electroluminescent element from the first pixel or the first electroluminescent element from the second pixel being driven in a given period within the interval, wherein the second active element comprises:

a first thin film transistor having a gate connected to the corresponding said gate line and one of a source and a drain connected to the corresponding said data line;

a second thin film transistor having a gate connected to the other one of the source and the drain of the first thin film transistor and one of a source and a drain connected to the corresponding said power supply line;

a capacitor connected between the gate and said one of the source and the drain of the second thin film transistor;

a third thin film transistor having one of a source and a drain connected to the other one of the source and the drain of the second thin film transistor, a first light emitting control signal from said at least one corresponding said light emitting control line applied to a gate, and the other one of the source and the drain connected to an anode electrode of one of the third electroluminescent element from the first pixel or the first electroluminescent element from the second pixel; and a fourth thin film transistor having one of a source and a drain connected to the other one of the source and the drain of the second thin film transistor, a second light emitting control signal from said at least one corresponding said light emitting control line applied to a gate, and the other one of the source and the drain connected to an anode electrode of the other one of the third electroluminescent element from the first pixel or the first electroluminescent element from the second pixel, wherein the second active element is configured to control the third thin film transistor and the fourth thin film transistor to connect the drain of the second thin film transistor to exactly one of the third electroluminescent element from the first pixel and the first electroluminescent element from the second pixel, and wherein the rows of pixels are configured to be first scanned sequentially for only the first light emitting element group and then afterwards scanned sequentially for the second light emitting element group.

29. An organic light emitting display device comprising:

a plurality of gate lines, a plurality of data lines, a plurality of light emitting control lines and a plurality of power supply lines; and a plurality of pixels arranged in rows, each said pixel being connected to a corresponding said gate line, a corresponding said data line, a corresponding said light emitting control line and a corresponding said power supply line, and having at least three electroluminescent elements, each said electroluminescent element for emitting a corresponding color within an interval, each of the electroluminescent elements comprising a first electrode and a second electrode and being a part of only one of the pixels, each said light emitting element being a member of either a first light emitting element group or a second light emitting element group, and each pixel including at least one light emitting element from each of the first light emitting element group and the second light emitting element group, wherein each row has a corresponding gate line and all of the pixels in a same row correspond to a same gate line; and a plurality of active elements for driving the electroluminescent elements, each of the active elements being coupled to the first electrodes of corresponding ones of the electroluminescent elements, wherein all of the second electrodes of the electroluminescent elements in at least two of the pixels are directly connected together, wherein a first active element of the active elements is configured to time-divisionally drive a first electroluminescent element and a second electroluminescent element from a first pixel among the plurality of pixels, and a second active element of the active elements is configured to time-divisionally drive a third electroluminescent element from the first pixel and a first electroluminescent element from a second pixel among the plurality of pixels, adjacent to the first pixel, the third electroluminescent element from the first pixel or the first electroluminescent element from the second pixel being driven in a given period within the interval, wherein the second active element comprises:

a first thin film transistor having a gate connected to the corresponding said gate line and one of a source and a drain connected to the corresponding said data line;

a second thin film transistor having a gate connected to the other one of the source and the drain of the first thin film transistor and one of a source and a drain connected to the corresponding said power supply line;

a capacitor connected between the gate and said one of the source and the drain of the second thin film transistor;

a third thin film transistor having one of a source and a drain connected to the other one of the source and the drain of the second thin film transistor, a light emitting control signal from the corresponding said light emitting control line applied to a gate, and the other one of the source and the drain connected to an anode of one of the third electroluminescent element from the first pixel or the first electroluminescent element from the second pixel; and a fourth thin film transistor having one of a source and a drain connected to the other one of the source and the drain of the second thin film transistor, the light emitting control signal applied to a gate, and the other one of the source and the drain connected to an anode of the other one of the third electroluminescent element from the first pixel or the first electroluminescent element from the second pixel, wherein the second active element is configured to control the third thin film transistor and the fourth thin film transistor to connect the drain of the second thin film transistor to exactly one of the third electroluminescent element from the first pixel and the first electroluminescent element from the second pixel, and wherein the rows of pixels are configured to be first scanned sequentially for only the first light emitting element group and then afterwards scanned sequentially for the second light emitting element group.

30. An organic light emitting display device comprising:

a plurality of gate lines, a plurality of data lines, a plurality of light emitting control lines and a plurality of power supply lines;

a display region comprising a plurality of pixels arranged in rows, each said pixel being connected to a corresponding said gate line, a corresponding said data line, a corresponding said light emitting control line and a corresponding said power supply line, each said light emitting element being a member of either a first light emitting element group or a second light emitting element group, and each pixel including at least one light emitting element from each of the first light emitting element group and the second light emitting element group, wherein each row has a corresponding gate line and all of the pixels in a same row correspond to a same gate line;

a gate line driving circuit for providing a plurality of scan signals to the plurality of gate lines;

a data line driving circuit for providing red, green, and blue data signals to the plurality of data lines;

a light emitting control signal generation circuit for providing light emitting control signals to the plurality of light emitting control lines;

a plurality of drive devices; and a plurality of sequential control devices coupled corresponding ones of the drive devices and corresponding ones of the light emitting elements, wherein each said pixel of the display region includes red, green, and blue electroluminescent elements that are separate from the red, green, and blue electroluminescent elements of all other said pixels, each of the electroluminescent elements comprising a first electrode and a second electrode, wherein all of the second electrodes of the electroluminescent elements of at least two of the pixels are directly connected together, and wherein at least one of said electroluminescent elements among the red, green, and blue electroluminescent elements of a first pixel among the plurality of pixels and at least one of said electroluminescent elements among the red, green, and blue electroluminescent elements of a second pixel among the plurality of pixels, adjacent to the first pixel, are grouped into at least a portion of a first light emitting element group, and remaining said electroluminescent elements of the first and second adjacent said pixels are grouped into at least a portion of a second light emitting element group, wherein said light emitting elements in the first light emitting element group or the second light emitting element group are driven corresponding to the data signals in response to a corresponding said light emitting control signal from the corresponding said light emitting control line during a given period within an interval, wherein the interval is one frame and the given period is a subframe, and wherein one frame is divided into two subframes, and the first light emitting element group is driven in one of the two subframes and the second light emitting element group is driven in the other one of the two subframes, wherein each of the sequential control devices is configured to supply a current from the corresponding one of the drive devices, selectively, to a light emitting element of the first light emitting element group or a light emitting element of the second light emitting element group, and wherein the rows of pixels are configured to be first scanned sequentially for only the first light emitting element group and then afterwards scanned sequentially for the second light emitting element group.

31. The organic light emitting display device of claim 30, wherein the light emitting elements of at least one of the first light emitting element group and the second light emitting element group sequentially or collectively emit light during the given period.

32. A method of driving a display device having a plurality of gate lines, a plurality of data lines, a plurality of light emitting control lines and a plurality of power supply lines, a plurality of drive devices, a plurality of sequential control devices, and a plurality of pixels arranged in rows, each said pixel connected to a corresponding said gate line, a corresponding said data line, a corresponding said light emitting control line and a corresponding said power supply line, and having at least red, green, and blue electroluminescent elements that are separate from the red, green, and blue electroluminescent elements of all other said pixels, each said electroluminescent element being a member of either a first electroluminescent element group or a second electroluminescent element group, and each pixel including at least one electroluminescent element from each of the first electroluminescent element group and the second electroluminescent element group, wherein each row has a corresponding gate line and all of the pixels in a same row correspond to a same gate line, the sequential control devices being coupled between the drive devices and the red, green, and blue electroluminescent devices, the method comprising:

grouping at least one of said electroluminescent elements among said at least red, green, and blue electroluminescent elements of a first pixel among the plurality of pixels, and at least one of said electroluminescent elements among said at least red, green, and blue electroluminescent elements of a second pixel among the plurality of pixels, adjacent to the first pixel, into at least a portion of a first light emitting element group, and grouping remaining said electroluminescent elements of the first and second adjacent said pixels into at least a portion of a second light emitting element group, wherein each of the electroluminescent elements comprises a first electrode and a second electrode, and all of the second electrodes of the electroluminescent elements of the first and second pixels are directly connected together;

time-divisionally driving the first light emitting element group and the second light emitting element group within an interval, wherein the interval is one frame and is divided into two subframes, and wherein the electroluminescent elements of the first light emitting element group emit light in one of the two subframes and the electroluminescent elements of the second light emitting element group emit light in the other one of the two subframes, to display a predetermined color during the one frame;

controlling, during the one of the two subframes, the sequential control devices to electrically connect the electroluminescent elements of the first light emitting group to corresponding ones of the drive devices and to electrically disconnect the electroluminescent elements of the second light emitting group from the corresponding ones of the drive devices; and controlling, during the other one of the two subframes, the sequential control devices to electrically connect the electroluminescent elements of the second light emitting group to corresponding ones of the drive devices and to electrically disconnect the electroluminescent elements of the first light emitting group from the corresponding ones of the drive devices, wherein the rows of pixels are first scanned sequentially for only the first electroluminescent element group and then afterwards scanned sequentially for the second electroluminescent element group.

33. The method of claim 32, wherein at least one of the first and second light emitting element groups includes at least two said light emitting elements emitting different colors, and substantially simultaneously emits said different colors in one of the two subframes.

34. The method of claim 32, wherein the light emitting elements of at least one of the first and second light emitting element groups are driven over the corresponding said gate line to sequentially or collectively emit light during one of the two subframes.

35. A method of driving a display device comprising a plurality of gate lines, a plurality of data lines, a plurality of light emitting control lines and a plurality of power supply lines, a plurality of drive devices, a plurality of sequential control devices, and a plurality of pixels, each said pixel connected to a corresponding said gate line, a corresponding said data line, a corresponding said light emitting control line, and a corresponding said power supply line, and having at least red, green, and blue electroluminescent elements that are separate from the red, green, and blue electroluminescent elements of all other said pixels, each said electroluminescent element being a member of either a first electroluminescent element group or a second electroluminescent element group, and each pixel including at least one electroluminescent element from each of the first electroluminescent element group and the second electroluminescent element group, wherein each row has a corresponding gate line and all of the pixels in a same row correspond to a same gate line, the sequential control devices being coupled between the drive devices and the red, green, and blue electroluminescent devices, the method comprising:

grouping at least one of said electroluminescent elements among said at least red, green, and blue electroluminescent elements of a first pixel among the plurality of pixels, and at least one of said electroluminescent elements among said at least red, green, and blue electroluminescent elements of a second pixel among the plurality of pixels, adjacent to the first pixel, into at least a portion of a first light emitting element group and grouping remaining said electroluminescent elements of the first and second adjacent said pixels into at least a portion of a second light emitting element group, wherein each of the electroluminescent elements comprises a first electrode and a second electrode, and all of the second electrodes of the electroluminescent elements of the first and second pixels are directly connected together;

writing data for driving the electroluminescent elements of at least one of the first light emitting element group and the second light emitting element group through the corresponding said data line in response to a scan signal provided from the corresponding said gate line during a first period within a given period of an interval;

collectively light emitting the electroluminescent elements of at least one of the first light emitting element group and the second light emitting element group using the written data during a second period within the given period of the interval, wherein the electroluminescent elements of at least one of the first light emitting element group and the second light emitting element group are sequentially driven per the given period of the interval, and wherein the interval is one frame, and the given period is a subframe, wherein one frame is divided into two subframes, and the first light emitting element group is driven in one of the two subframes and the second light emitting element group is driven in the other one of the two subframes;

controlling, during the one of the two subframes, the sequential control devices to electrically connect the electroluminescent elements of the first light emitting group to corresponding ones of the drive devices and to electrically disconnect the electroluminescent elements of the second light emitting group from the corresponding ones of the drive devices; and controlling, during the other one of the two subframes, the sequential control devices to electrically connect the electroluminescent elements of the second light emitting group to corresponding ones of the drive devices and to electrically disconnect the electroluminescent elements of the first light emitting group from the corresponding ones of the drive devices, wherein the rows of pixels are first scanned sequentially for only the first electroluminescent element group and then afterwards scanned sequentially for the second electroluminescent element group.

36. The method of claim 35, wherein each said subframe is divided into the first period for writing data and the second period for collectively light emitting the electroluminescent elements.

37. The display device of claim 1, wherein a third active element of the active elements is configured to time-divisionally drive a second light emitting element and a third light emitting element from the second pixel.

* * * * *